US006943347B1

(12) United States Patent
Willoughby et al.

(10) Patent No.: US 6,943,347 B1
(45) Date of Patent: Sep. 13, 2005

(54) LAMINATED TUBE FOR THE TRANSPORT OF CHARGED PARTICLES CONTAINED IN A GASEOUS MEDIUM

(76) Inventors: Ross Clark Willoughby, 655 William Pitt Way, Pittsbugh, PA (US) 15238; Edward William Sheehan, 655 William Pitt Way, Pittsburgh, PA (US) 15238

( * ) Notice: Subject to any disclaimer, the term of this patent is extended or adjusted under 35 U.S.C. 154(b) by 59 days.

(21) Appl. No.: 10/688,021

(22) Filed: Oct. 17, 2003

Related U.S. Application Data

(60) Provisional application No. 60/419,699, filed on Oct. 18, 2002.

(51) Int. Cl.[7] ..... H01J 49/06
(52) U.S. Cl. ..... 250/288
(58) Field of Search ..... 250/288, 281, 250/282, 287

(56) References Cited

U.S. PATENT DOCUMENTS 4,542,293 A * 9/1985 Fenn et al. ..... 250/288
4,977,320 A 12/1990 Chowdhury et al.
5,280,175 A * 1/1994 Karl ..... 250/281
5,736,740 A 4/1998 Franzen
5,747,799 A 5/1998 Franzen
6,107,628 A 8/2000 Smith et al.
6,359,275 B1 3/2002 Bertsch et al.
6,486,469 B1 11/2002 Fisher et al.
6,583,407 B1 6/2003 Fisher et al.
6,583,408 B2 6/2003 Smith et al.
6,744,041 B2 * 6/2004 Sheehan et al. ..... 250/283
6,818,889 B1 * 11/2004 Sheehan et al. ..... 250/288
2002/0185595 A1 12/2002 Smith et al.
2003/0034452 A1 2/2003 Fisher et al.

FOREIGN PATENT DOCUMENTS

WO WO 03/010794 A2 2/2003

OTHER PUBLICATIONS

Lin, B., Sunner, J., "Ion transport by viscous gas flow through capillaries", J. Am. Soc. Mass Spectrom. 5, pp. 873–885 (1994).

* cited by examiner

*Primary Examiner*—Jack I. Berman

(57) ABSTRACT

An improved tube for accepting gas-phase ions and particles contained in a gas by allowing substantially all the gas-phase ions and gas from an ion source at or greater than atmospheric pressure to flow into the tube and be transferred to a lower pressure region. Transport and motion of the ions through the tube is determined by a combination of viscous forces exerted on the ions by the flowing gas molecules and electrostatic forces causing the motion of the ions through the tube and away from the walls of the tube. More specifically, the tube is made up of stratified elements, wherein DC potentials are applied to the elements so that the DC voltage on any element determines the electric potential experience by the ions as they pass through the tube. A precise electrical gradient is maintained along the length of the stratified tube to insure the transport of the ions. Embodiments of this invention are methods and devices for improving the sensitivity of mass spectrometry or ion mobility spectrometers when coupled to atmospheric and above atmospheric pressure ionization sources. An alternate embodiment of this invention applies an AC voltage to one or more of the conducting elements in the laminate.

21 Claims, 16 Drawing Sheets

LAMINATED TUBE FOR THE TRANSPORT OF CHARGED PARTICLES CONTAINED IN A GASEOUS MEDIUM

CROSS-REFERENCE TO RELATED APPLICATION

This application claims the benefit of Provisional Patent Application Ser. No. 60/419,699, filed 2002, Oct. 18. This application is related to Provisional Patent Application Ser. No. 60/210,877, filed Jun. 9, 2000 now patent application Ser. No. 09/877,167, Filed Jun. 8, 2001; Provisional Patent Application Ser. No. 60/384,864, filed Jun. 1, 2002 now patent Application Ser. No. 10/449,344, Filed May 30, 2003; Provisional Patent Application Ser. No. 60/384,869, filed Jun. 1, 2002 now patent Application Ser. No. 10/449,147, Filed May 31, 2003; Provisional Patent Application Ser. No. 60/410,653, filed Sep. 13, 2002 now patent application Ser. No. 10/661,842, filed Sep. 12, 2003; and Provisional Patent application Ser. No. 60/476,582, filed Jun. 7, 2003.

FEDERALLY SPONSORED RESEARCH

The invention described herein was made with United States Government support under Grant Number: 1 R43 RR143396-1 from the Department of Health and Human Services. The U.S. Government may have certain rights to this invention.

SEQUENCE LISTING OR PROGRAM

Not applicable.

BACKGROUND

1. Field of Invention

This invention relates to laminated capillaries which are used for interfacing higher pressure ionization sources to lower pressure ion destinations such as mass spectrometers, ion mobility spectrometers, and ion beam targets.

2. Background—Description of Prior Art

Dispersive sources of ions at or near atmospheric pressure, such as, atmospheric pressure discharge ionization, chemical ionization, photoionization, or matrix assisted laser desorption ionization, and electrospray ionization, generally have low sampling efficiency through conductance or transmission apertures and capillaries or tubes. Less than 1% [often less than 1 ion in 10,000] of the ion current emanating from the ion source is detected in the lower pressure regions of the present commercial interfaces for mass spectrometry.

FIG. 1 show simulated trajectories of ions approaching a capillary entrance from a 400 V/mm ion source region into the relatively field-free inner channel of a capillary. A viscous [gas] flow velocity component is added to these ions in the direction of the capillary flow. This simulation shows the electric field penetration from the source region creates significant dispersion of ions and loss of ions to the walls at the inlet of a capillary. The losses of ions to walls will generally have two consequences; first, in the case of conducting [metal] capillaries, the ions will give up charge (usually through a redox process) or, second, in the case of dielectric materials [glass] the ion will accumulate on the surface and further retard introduction of subsequent ions into the flow through the capillary. Either way, the ions are primarily lost at or slightly downstream of the entrance of the capillary tube.

U.S. Pat. No. 4,542,293 Fenn et al. (1985)[1] demonstrates the utility of utilizing a dielectric [glass] capillary with metal ends with a large electric potential difference along the axis of the capillary, referred to capacitive charging, to transport gas-phase ions from atmospheric pressure to low pressure where the viscous forces within a capillary push the ions against a electrical potential gradient. This technology has the significant benefit of allowing grounded needles with electrospray sources. Unfortunately, this mainstream commercial technology[2] transmits only a fraction of a percent of typical atmospheric pressure generated ions into the vacuum. The majority of ions are lost at the inlet of the capillary due to the dispersive electric fields, at the inlet, dominating the motions of ions (FIG. 1).

The requirement for capacitive charging of the dielectric tube for the transmission of ions, as well as, the acceptance or entry of ions into the capillary, is highly dependent on the charges populating the inner- and outer-surface of the capillary. This dependence of surface charging limits the acceptance and transmission efficiencies of Fenn et al.'s technology. Contamination of the large surface area of the inner-walls of the capillary from condensation, ion deposition, particulate material or droplets can change the surface properties and therefore reducing these efficiencies. In addition, since a large amount of energy is stored within the capillary, contamination can lead to electrical discharges and damage to the capillary, sometimes catastrophic. Therefore, care must also be taken to keep the inner- and outer-surfaces clean and unobstructed, presumably in order not to deplete the image current that flows on the outer-surface of the dielectric or the current that flows along the inner-surface.

Examples of metal capillaries are disclosed—for example, in U.S. Pat. No. 4,977,320 to Chowdhury et al. (1990)[3], and U.S. Pat. No. 6,583,408 B2 (2003)[4] and in U.S. patent application publication 2002/0185559 A1 (2002)[5] both to Smith et al. Chowdhury et al. and Smith et al. both demonstrated the use of heated metal capillaries to both generate and transmit ions into the vacuum. The efficiencies of these devices are low as well. This technology samples both ions and charged droplets into the capillary where, with the addition of heat, ion desorption is facilitated. Drops undergoing coulomb explosions inside of a restricted volume of the lumen of the capillary will tend to cause dispersion losses to the walls were the charges are quickly neutralized and: not resulting in the surface charging up. But similar to Fenn et al.'s dielectric capillary, this technique suffers the same limitation from losses at the inlet due to the dispersive electric fields (FIG. 1), as described above.

Lin and Sunner (1994)[6] studied a variety of effects on transmission through tubes of glass, metal, and Teflon. A wide variety of parameters were studied including capillary length, gas throughput, capillary diameter, and ion residence time. Effects from space charge, diffusion, gas flow, turbulence, spacing, and temperature where evaluated and discussed. Some important insights where reported with respect to general transmission characteristics of capillary inlets. However, they failed to identify field dispersion at the inlet as the first step in the loss of ions. In the case of glass capillaries, this dispersion and eventual impact of the ions on the inner-surfaces of capillary lumen leads to charging of the inner-surface of the capillary lumen at the entrance of the capillary preventing ions from entering into the capillary.

Several approaches have been proposed to eliminate or reduced the charging of the surfaces at the entry of glass or dielectric capillaries—for example, in U.S. Pat. No. 5,736,740[7] (1998) and U.S. Pat. No. 5,747,799[8] (1998) both to Franzen, U.S. Pat. No. 6,359,275 B1 to Bertsch et al. (2002)[9]; and U.S. Pat. No. 6,486,469 B1 (2002)[10] and U.S. Pat. No. 6,583,407 B1 (2003)[11], and U.S. patent application publication 2003/003452 A1 (2003)[12] all to Fischer et al. Franzen (U.S. Pat. No. 5,736,740) proposes the use of a highly resistive coating on the inner surfaces of the capillary tube or use capillaries that are themselves highly resistive, such as, glass capillaries, to prevent charge accumulation as a means to facilitate the focusing of ions toward the axis of the capillary. Although it is difficult to distinguish this art from Fenn et al. (U.S. Pat. No. 4,542,293), in that the glass tubes in both approaches are highly resistive [or weakly conducting dielectrics], Franzen does argue effectively for the need to control the inner surface properties and therefore the internal electric fields. Irregardless, Franzen's approach will suffer from the same limitations as Fenn's, that is loss of ions in the dispersive electric fields at the inlets of capillaries and apertures.

Bertsch et al. (U.S. Pat. No. 6,359,275 B1) proposes a similar approach to Franzen to prevent charging of the surface by coating the inner-surface. But unlike Franzen, Bertsch et al. coats the inner-surface of the capillary near the capillary entrance with a conductive material, thereby bleeding away any charge that builds up on the inner-surface to the end-cap. Bertsch et al. eliminates surface charging while still keeping the benefits of the dielectric tube transport in the nondispersive region [downstream region] of the capillary. This approach addresses the problem of charge accumulation on the inner-surfaces, but it does not remove the significant losses of ions at the inlet due to dispersion (FIG. 1). Again, suffering the same limitations of Fenn et al.'s, Franzen's, and Chowhdury et al.'s devices—lose of ions at the inlet due to dispersive electric fields.

Franzen (U.S. Pat. No. 5,747,799) and W.O. patent 03/010794 A2 to Forssmann et al. (2002)[13] addresses the need to focus ions at or into the Inlet of capillaries and apertures in order enhance collection efficiencies by the use of a series of electrostatic lens at or in front of the inlet. In Franzen's device the ions are said to be first, attracted to the inlet by electrostatic potentials and once in the vicinity of the inlet the ions are entrained into the gas flowing into the tube or aperture by viscous friction. This invention fails to account for the dominance of the electric field on the motion of ions in the entrance region. At typical flow velocities at the entrance of tubes or apertures, the electric fields will dominate the motion of the ions and the ions that are not near the capillary axis will tend to disperse and be lost on the walls of the capillary or aperture inlet. With this device, a higher ion population can be presented to the conductance opening at the expense of higher field ratios across the aperture or along the capillary but at the expense of higher dispersion losses inside the aperture or tube.

Forssmann et al. (03/010794 A2) describes a series of electrodes, or funnel optics, upstream of the capillary inlet in order to concentrate and direct ions toward or into the capillary inlet. This approach utilizes funnel optics in front of an electrospray source in order to concentrate ions on an axis of flow by imposing focusing electrodes of higher electrical potential than the bottom of the so called accelerator device, the first electrode in the series. This device frankly will not work. The ions formed by the electrospray process will be repelled by this funnel optics configuration and little to no transmission of ions to the aperture or capillary inlet will occur. Most of the inertial energy acquired by the ions in the source region is lost to collisions with neutral gas molecules at atmospheric pressure; consequently the only energy driving the ions in the direction of the capillary inlet or aperture will be the gas flow which under normal gas flows would be insufficient to push the ions up the field gradient imposed by the funnel optics. This device does not operate in fully developed flow as will be described in the present invention.

U.S. Pat. No. 6,486,469 B1 (2002) and U.S. Pat. No. 6,583,407 B1 (2003); and U.S. patent application publication 2003/003452 A1 (2003) to Fischer et al. all utilize external electrodes and butted dielectric tubes to provide enhanced control of the electric fields within the capillary. While Fischer et al. (U.S. Pat. No. 6,583,407 B1) utilize the conductive coating proposed by Bertsch et al. (U.S. Pat. No. 6,359,275 B1) to eliminate surface charging, all three devices do not address issues related to inlet losses due to dispersive electric fields at the inlets of capillaries and apertures, as presented in FIG. 1. In addition, all these devices still utilize significantly large dielectric inner-surfaces with the associated problems with surface charging, contamination, and discharge.

References

[1] Fenn, J. B., Yamashita, M., Whitehouse, C., "Process and apparatus for changing the energy of charged particles contained in a gaseous medium," U.S. Pat. No. 4,542,293 (Sep. 17, 1985).

[2] See Analytica of Branford, Branford, C T, http://aob.com; Agilent Technologies, Wilmington, Del., http://agilent.com/chem; and Bruker Daltonics, Billerica, Mass., http://www.bdal.com.

[3] Chowdhury, S. K., Katta, V., Chait, B. T., "Electrospray ionization mass spectrometer with new features", U.S. Pat. No. 4,977,320 (Dec. 11, 1990).

[4] Smith, R. D., Kim, T., Tang, K., Udseth, H. R., "Ionization source utilizing a jet disturber in combination with an ion funnel and method of operation," U.S. Pat. No. 6,583,408 B2 (Jun. 24, 2003).

[5] Smith, R. D., Kim, T., Udseth, H. R., "Ionization source utilizing a multi-capillary inlet and method of operation," U.S. Patent Application Publication 2002/0185595 A1 (Dec. 12, 2002).

[6] Lin, B., Sunner, J., "Ion transport by viscous gas flow through capillaries", J. Am. Soc. Mass Spectrom. 5, pages 873–885 (1994).

[7] Franzen, J., "Method and device for transport of ions in a gas through a capillary," U.S. Pat. No. 5,736,740 (Apr. 7, 1998).

[8] Franzen, J., "Method and device for the introduction of ions into the gas stream of an aperture to a mass spectrometer," U.S. Pat. No. 5,747,799 (May 5, 1998).

[9] Bertsch, J. L., Fisher, S. M., Riccomini, J. B., "Dielectric conduit with end electrodes", U.S. Pat. No. 6,359,275 B1 (Mar. 19, 2002).

[10] Fisher, S. M., Russ, C. W., "Dielectric capillary high pass ion filter", U.S. Pat. No. 6,486,469 B1 (Nov. 26, 2002).

[11] Fisher, S. M., Russ, C. W., "Method and apparatus for selective ion delivery using ion polarity independent control", U.S. Pat. No. 6,583,407 B1 (Jun. 24, 2003).

[12] Fisher, S. M., Russ, C. W., "Dielectric capillary high pass ion filter", U.S. Patent Application Publication 2003/0034452 A1 (Feb. 20, 2003).

[13] Forssmann, W-G, John, H., Walden, M., "Mass Spectrometry Device," WO Patent 03/010794 A2 (Feb. 6, 2003).

SUMMARY OF INVENTION

In accordance with the present invention a stratified or laminated tube comprises alternating layers of conducting electrodes and insulating (or dielectric) bases with an inlet for the introduction of gas-phase ions or charged particles and an exit, with an optional high-transmission surface populated with a plurality of openings upstream of stratified tube and a counter-flow of gas, for the introduction of ions into a lower pressure region. The electric potentials applied to the conducting electrodes are intended to provide a potential surface for the transfer of substantially all ions from an ion source region into the inlet of the laminated tube, transfer through the tube with minimal loses, and introduce the ions into a lower pressure region of user definable initial and exit potentials relative other components in the device. In some modes of operation the potentials can be varied to select specific species based on mobility.

To avoid the dispersion losses characterized by FIG. 1 the current device eliminates the field penetration into the capillary tube from a higher field source (or optics region) upstream from the inlet of the capillary tube by applying accelerating potentials to successive layers of the laminated tube. The ions entering the tube are accelerated through the Region of Flow Development as illustrated in FIG. 2 by these successive laminates. Since the velocity of the gas velocity at the entrance of the tube ($V_{ent}$) is substantially below the maximum velocity ($V_{max}$) in fully developed flow, the current device delays the dispersion (if at all) until the viscous forces are more capable of overcoming the dispersive effects from decreased electric fields. Once the ions traverse this Region of Flow Development, dispersive electric fields can be applied through successive laminate potentials in order to accomplish a variety of controlled optical processes; namely, to allow the ions to traverse a repulsive gradient, to select specific ions based on ion mobility, to store ions for brief periods, and to focus ions.

Delaying dispersion until fully developed flow exists will eliminate the significant losses that occur at the entrance to the capillary. And in addition, by delaying dispersion until the ions are in fully developed gas flow the motion of the ions will be dominated by viscous forces in the controlled electric fields within the tube. FIG. 3 shows a graph of the Entrance Boundary Distance ($L_{ent}$) as a function of tube diameter showing the requirement to delay dispersion for many centimeters [down the length of the tube] with larger diameter tubing while reducing this distance to below a millimeter in smaller diameter tubing—illustrating the dimensional requirements for the current device. The dimensional requirements for the present device also indicate the need for macro- and possible micro-fabrication processes to create precision laminates.

FIGS. 4A thru 4D show computer simulation of the operation of the present laminated tube device with A) a uniform electric field generated through the entire length of the capillary (Note that dispersion is delayed in this embodiment until the exit of the tube), B) a dispersive well created by applied DC potentials located in a region of fully developed flow (Note a lower electric field at the exit of the tube allows higher inlet fields), and C) a focusing region created by applied RF potentials located in a region of fully developed flow (Note that RF potentials can be used to overcome diffusion losses in long tubes one the ions have traversed $L_{ent}$).

OBJECTIVES AND ADVANTAGES

Accordingly, besides the objects and advantages of the laminated high transmission surfaces described in our co-pending patents, several objects and advantages of the present invention are:

(a) to provide a laminated tube with no or minimal loses of ions or charged particles while transferring the ions into a lower pressure regions for mass spectrometric analysis, ion mobility analysis, and or ion beam deposition or ion chemistry, (b) to provide a laminated tube that substantially all the ions are transfer through the tube and are not deposited and contaminating the lumen of the tube, leading to a buildup of surface charged, (c) to provide a laminated tube the restricts the flow of gas into the lower pressure regions, thereby reducing the gas-load on the device and any vacuum pumping associated with these regions, (d) to provide a laminated tube that allows any surface charge that does buildup on the inner surface of the tube to be bleed away through the metal laminates that made up the tube, (e) to provide a laminated tube that can transfer substantially all gas-phase ions from ion sources that operate at pressures greater than atmospheric pressure delivering the ions into a region at or near atmospheric pressure where they can be sampled by conventional atmospheric interfaces, either aperture or glass tube based, to mass spectrometers or other analytical devices, such as, ion mobility spectrometers, (f) to provide a laminated tube that can transfer substantially all gas-phase ions or charged particles from ion sources that operate at pressures greater than atmospheric pressure delivering the ions into a region at or near atmospheric pressure where they can be directed at surfaces for deposition or surface chemistry, or reacted with other gas phase species or particulate materials.

(g) to provide static focusing or shaping of the electric fields at the inlet of the laminated tube, which will focus a substantial proportion of ions into the inlet of the tube irregardless of the source of ions, (h) to provide dynamic or static focusing or shaping of the electric fields at the exit of the laminated tube at lower pressures, which will prevent ions from being lost due to dispersion or scattering as the ions exit the tube, (i) to provide dynamic focusing or shaping of the electric fields of at least one of the multitude of conducting electrodes to select or store ions inside the tube, (j) to provide to the operator a user controllable or tunable field ratios at the entrance to the tube and along the entire length of the tube that results in improved transfer of ions from higher pressure regions into lower pressure regions, Further objectives and advantages are to provide a laminated tube which can be easily and conveniently incorporated into existing atmospheric interfaces without the need for extensive or major reconstruction of the interface, which is simple to operate and inexpensive to manufacture, which can be used with either highly dispersive or low electrostatic or electrodynamic field ion sources; to provide a tube which can be manufactured by the techniques of microelectronics fabrication; which obviates the need for the ion source to be proximal to the inlet into the ion collection region or mass spectrometric device; etc. Still further objects and advantages will become apparent from a consideration of the ensuing descriptions and drawings.

DRAWING FIGURES

In the drawings, closely related figures have the same number but different alphabetic suffixes.

FIGS. 1A and 1B show computer simulation of ion trajectories at the entrance of capillary tubes where ions are transported from A) a 200 V/mm entrance region into the relatively field-free inner volume of the tube, and B) a 2000 V/mm entrance region into the relatively field-free inner volume of the tube. Note the field penetration into the tube results in significant losses due to field dispersion in the region at or near the entrance. A high ratio of outer to inner field will make the effective ion sampling aperture ($a_{eff}$) quite small.

FIG. 2 illustrates the flow properties of gas traveling through the entrance region of a capillary tube. The initial region (Region of Flow Development) is where the gas goes from approximately plug flow to parabolic flow. In this region there is a significant increase in linear velocity of the gas. Under ideal conditions the gases will approach the speed-of-sound in this region.

FIG. 3 is a graph of the Entrance Boundary Region (Lent) for fully developed as a function of tube diameter calculated for 25 cm tubes.

FIGS. 4A thru 4C show computer simulation of the ion trajectories for various operating modes of laminated tubes.

FIGS. 5A thru 5D shows cross-sectional illustrations of various laminated tubes.

FIG. 6 shows graphs of the electric potential experienced by the charged particles or ions as they pass through a laminated tube: Curve A showing the potential minimizing (point b') near the entrance of a tube and showing the gradual (Section c') increase in the potential as the ions move further down the tube toward the exit of the tube, Curve B showing the potential minimizing (point b') near the exit of a tube and with a sharp increase in the potential as the ions move further down the tube toward the exit of the tube, Curve C showing the potential energy minimizing (point b') in the middle of a tube with a gradual decrease in the potential (Section a') as the ions move from the entrance of the tube to point b and a gradual increase in the potential (Section c') as the ions move from point b toward the exit of the tube.

REFERENCE NUMERALS IN DRAWINGS

Figure 1:
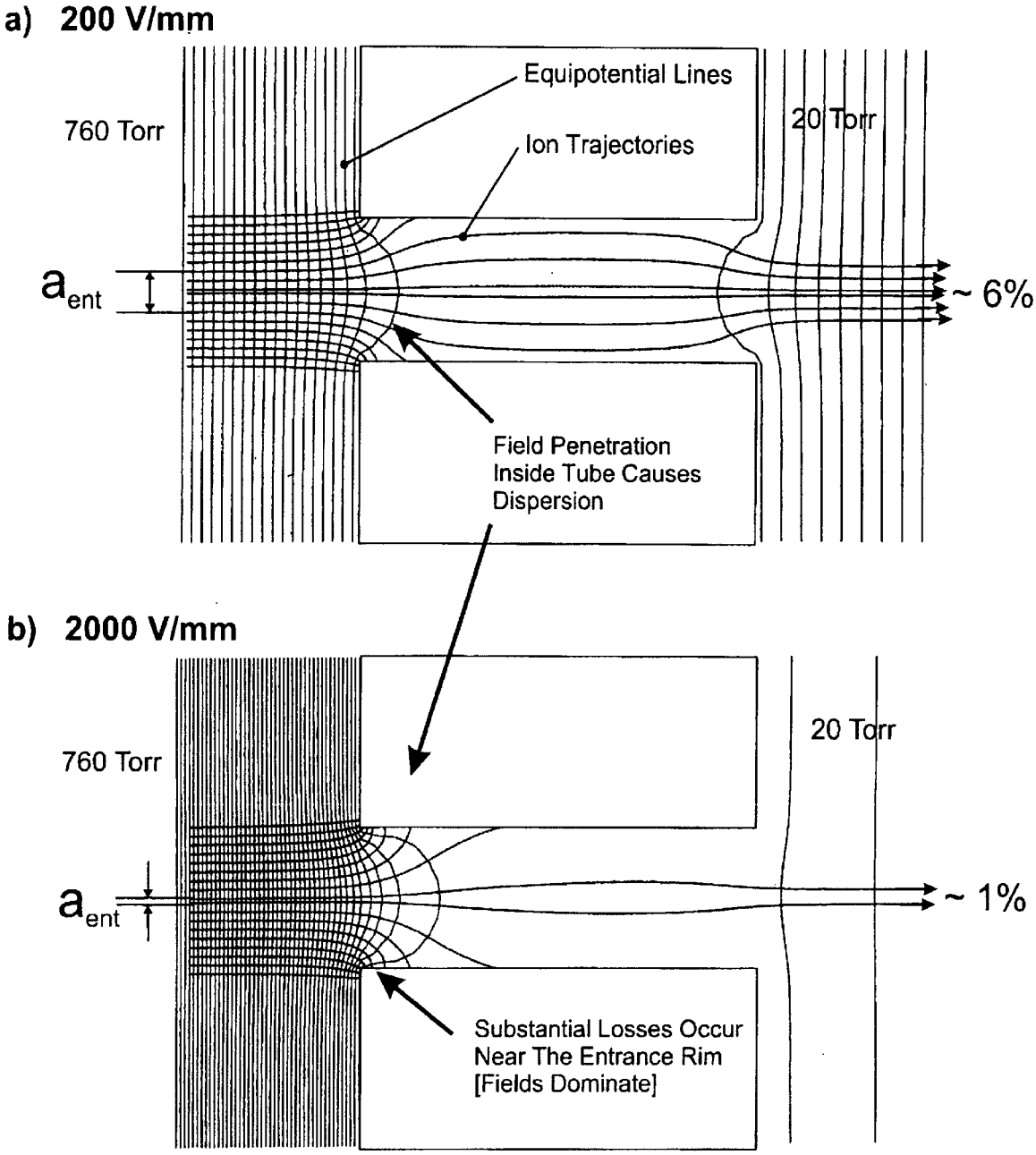
Figure 2:
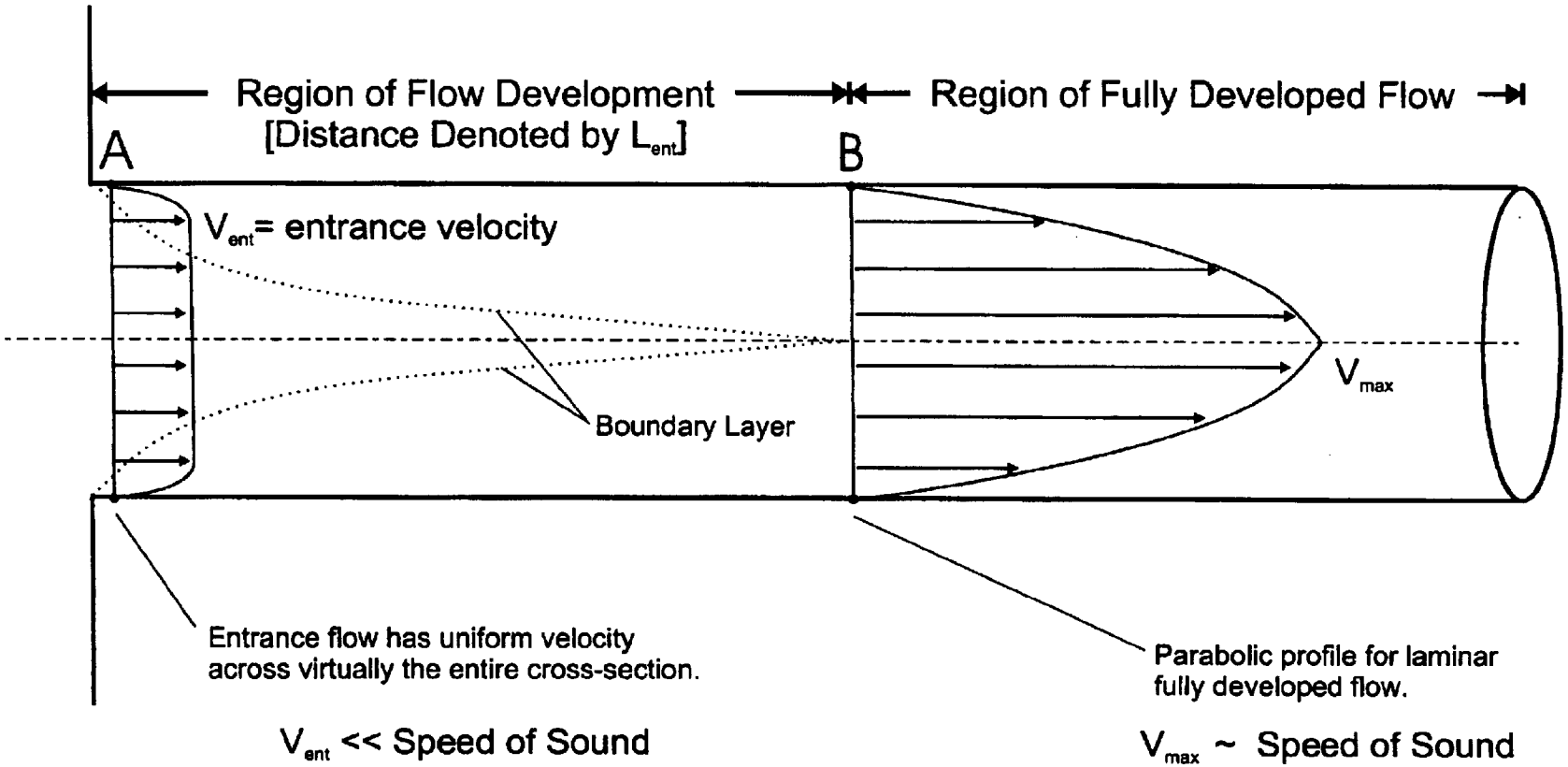
Figure 3:
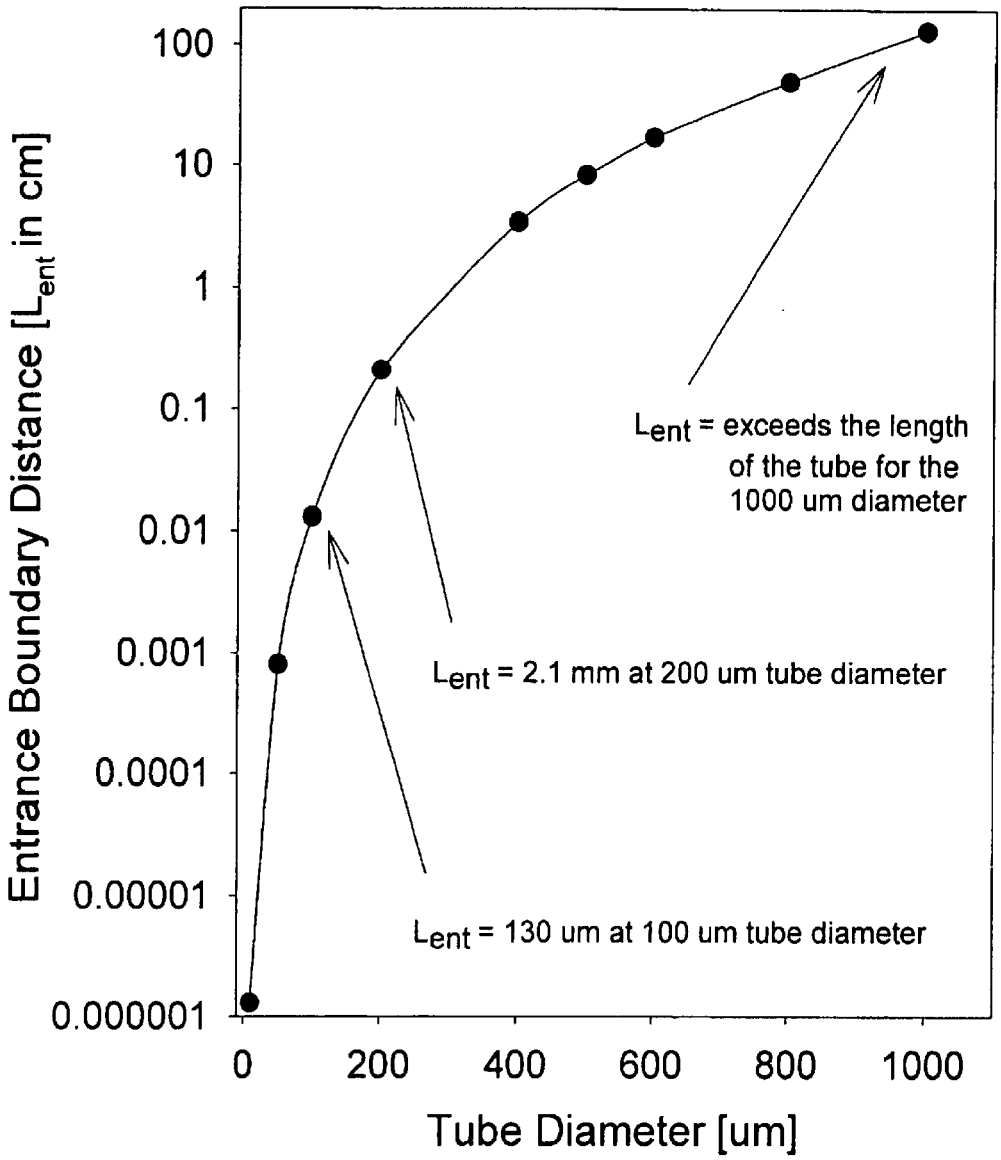
Figure 4A:
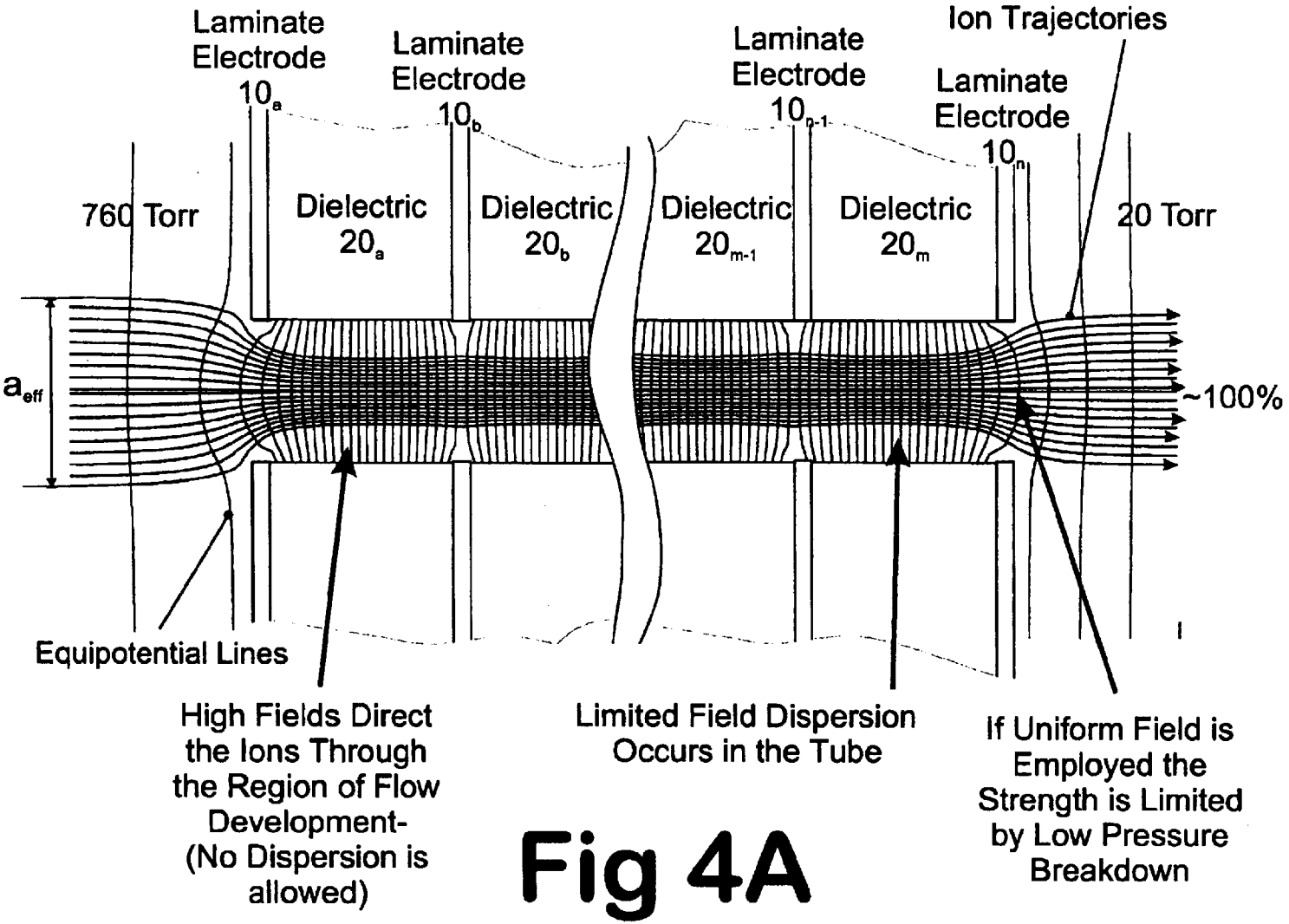
Figure 4B:
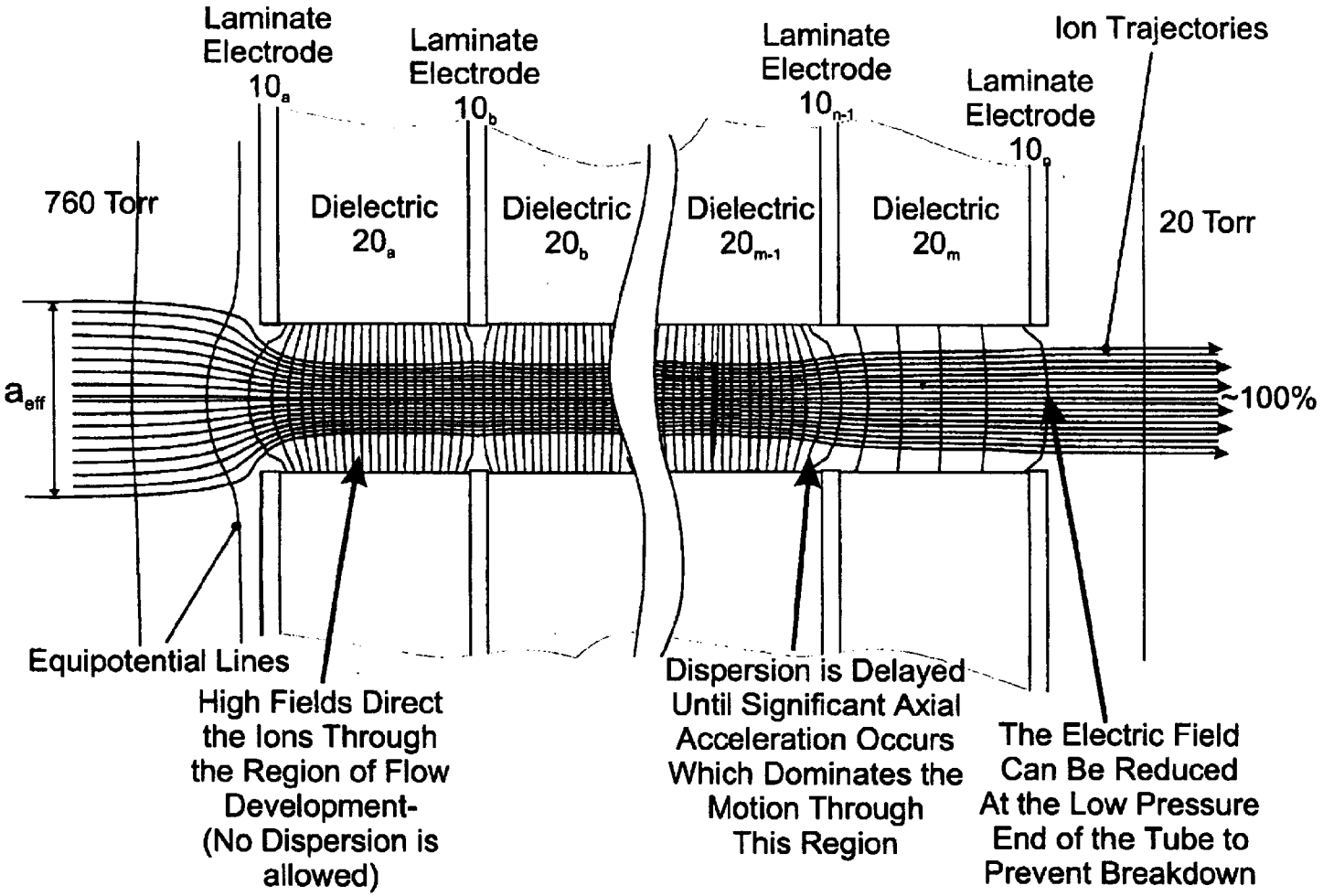
Figure 4C:
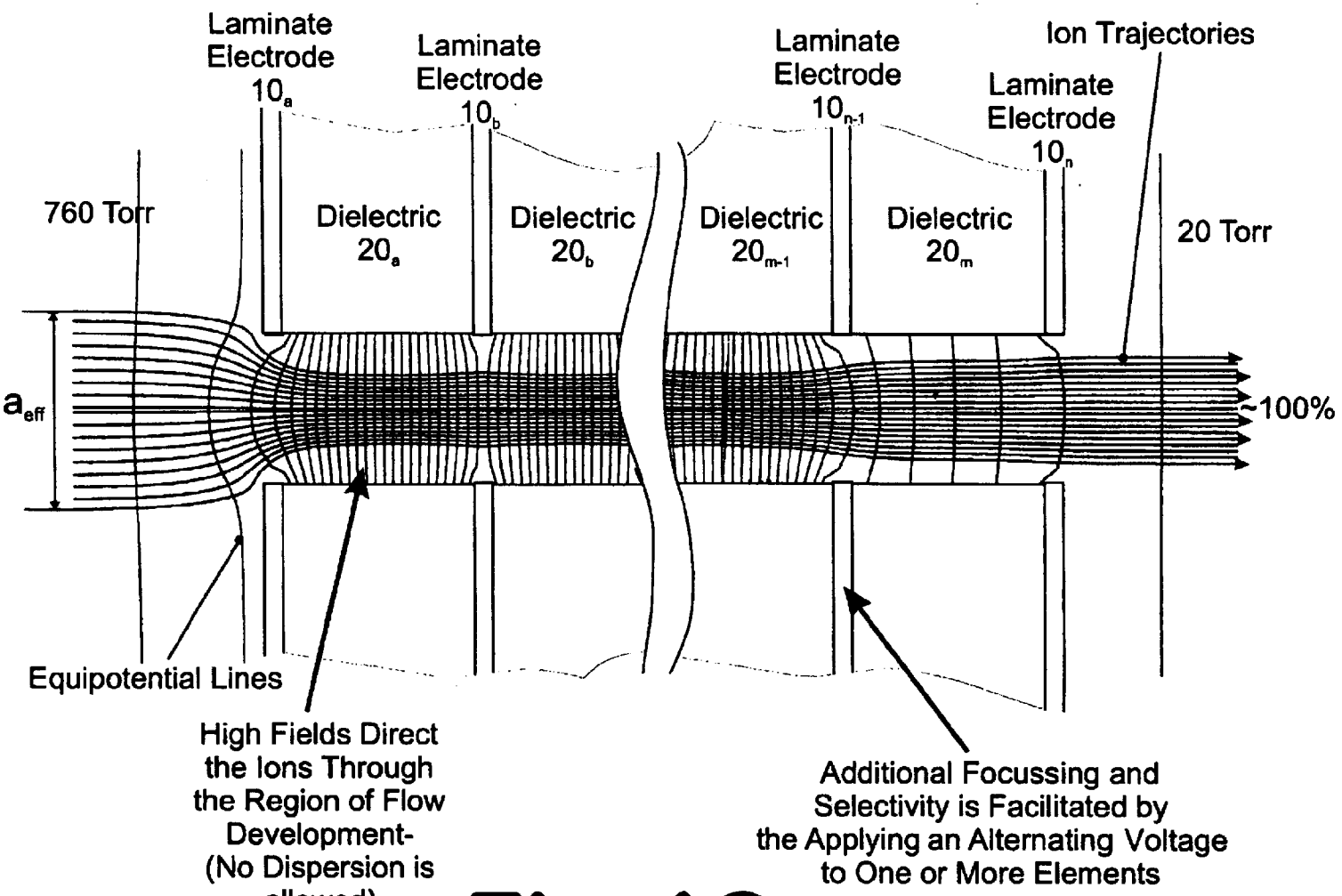

1 ion-source region
2 tube entrance region
3 tube exit region
10 metal laminate or layers (designated with a through n subscripts)
12 heat source
14 high voltage supplies
18 general direction of ion flow
20 base layers (designated with a through m subscripts)
30 tube inner surface or lumen
40 entrance aperture
42 tube exhaust outlet
44 tube exhaust destination
50 exit aperture
60 exit region wall element
62 aperture
70 ion-collection region
80 exit region wall element
100 entrance region wall element
110 electrode
120 aperture
130 ion-source cylindrical wall
140 ring insulator
150 sample source
160 delivery means
170 ion-source entrance wall
180 ring insulator
190 ring insulator
200 ion source gas source
202 ion source gas inlet
210 tube entrance gas source
212 tube entrance gas inlet
220 exhaust destination
222 exhaust outlet
230 high-transmission element
240 shielding electrode
250 back lens
260 laminated high-transmission insulator
262 front HTE laminate
264 back HTE laminate
266 interlaminate space
267 backlens
268 front lens
300 equipotential lines
302 potential well bottom

DESCRIPTION—FIGS. 5A, 7 AND 10—PREFERRED EMBODIMENT

Figure 5A:
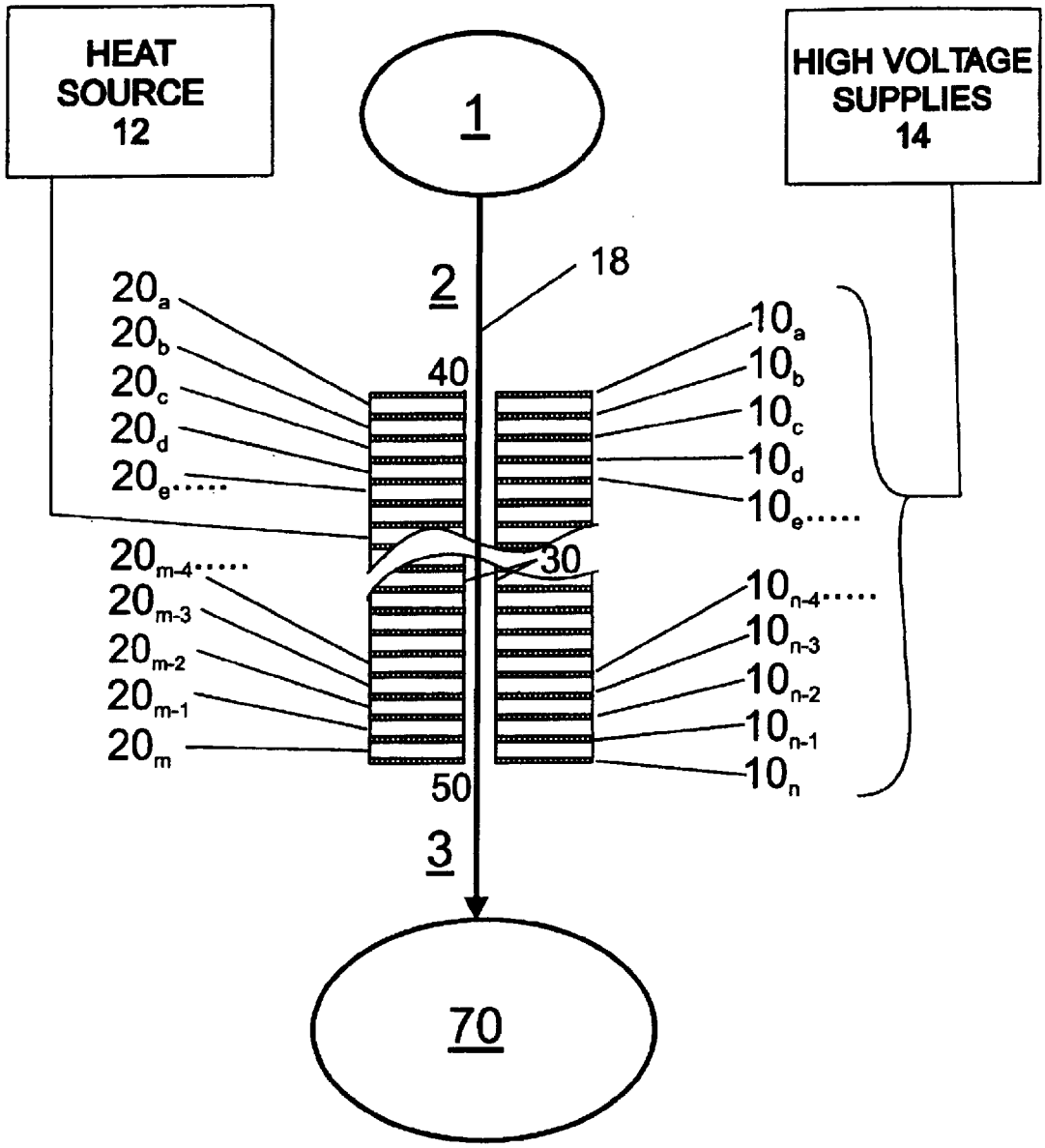
Figure 7:
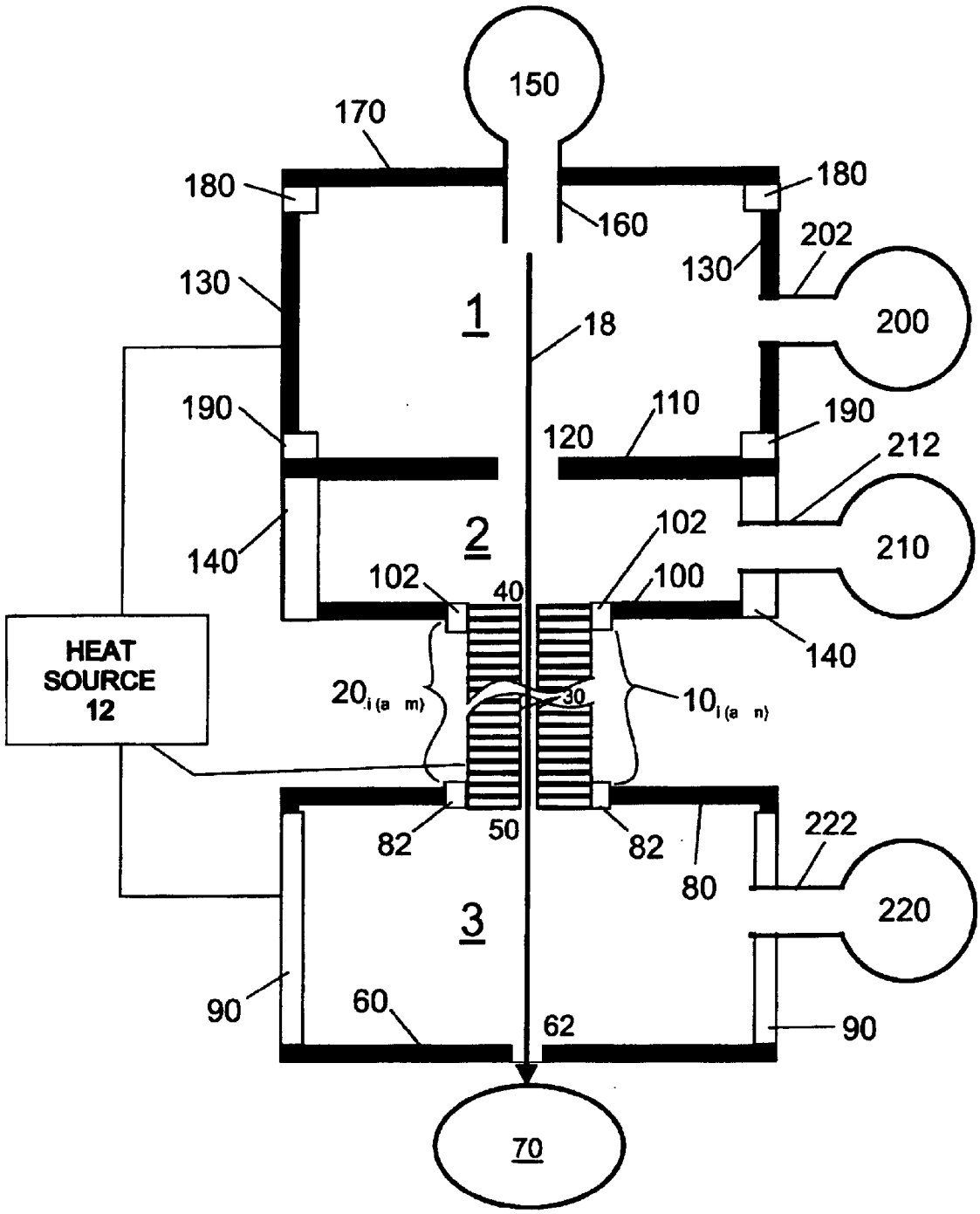
FIG. 7 shows a laminated tube configured with an atmospheric pressure ion source with funnel-well optics.
Figure 10:
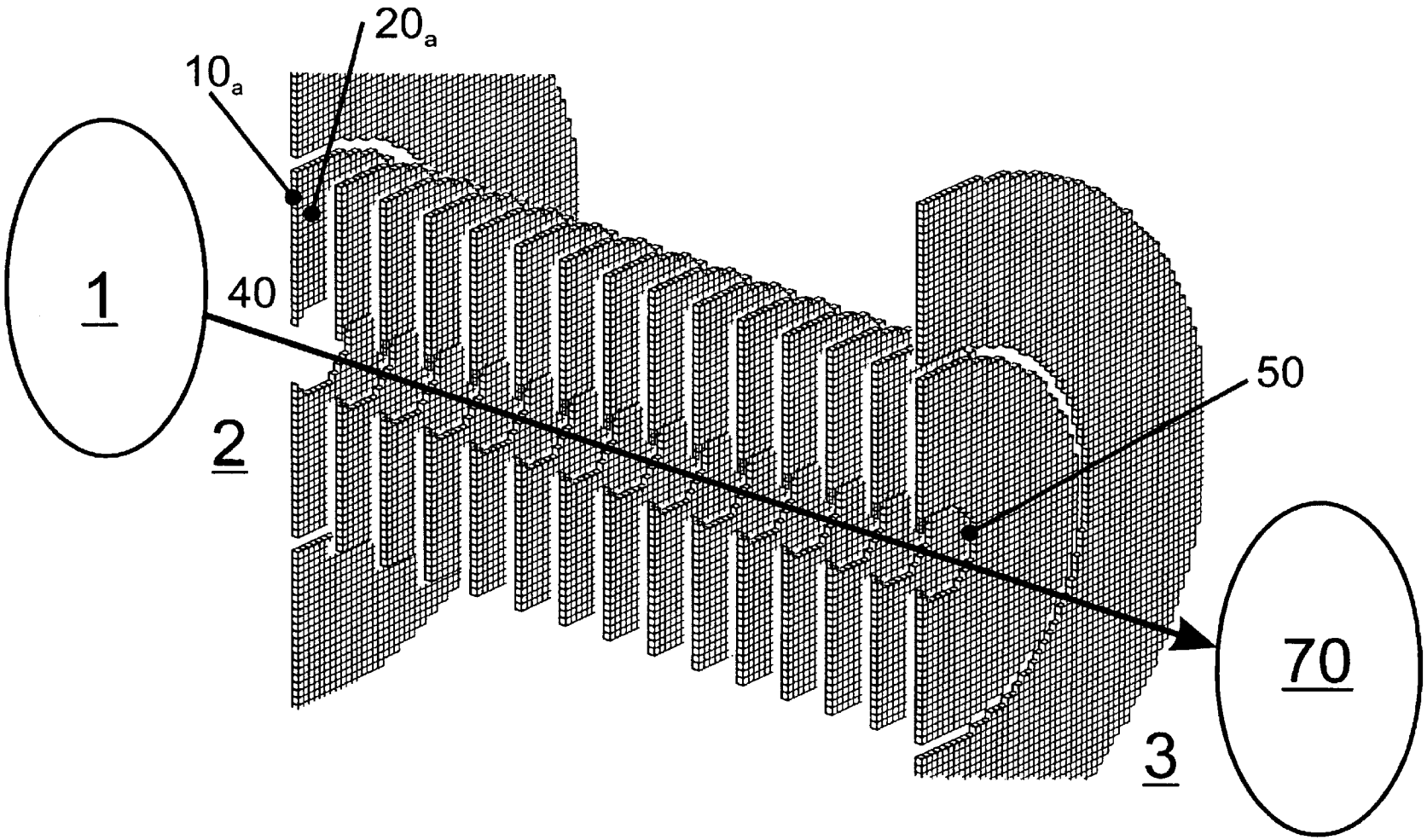
FIG. 10 shows a three-dimensional cutaway of the laminated tube shown in FIG. 5A.

A preferred embodiment of the laminated-tube or just tube of the present invention is illustrated in FIG. 5A, FIG. 7, and FIG. 10. The tube is made-up of a series of thin concentric planar metal laminates or layers 10, designated $\mathbf{10}_a$, $\mathbf{10}_b$, $\mathbf{10}_c$, . . . $\mathbf{10}_{n-2}$, $\mathbf{10}_{n-1}$, $\mathbf{10}_n$, separated from each other by a thin base layers 20, designated $\mathbf{20}_a$ through $\mathbf{20}_m$, of uniform cross section and thickness consisting of non-conducting insulating material, the aggregate of metal laminatelbase pairs forming a lumen, defined by a laminatelbase inner surface or lumen 30. The tube thus has an entry 40 and an exit aperture 50 for introducing gases and gas-phase ions or charged particles from a tube entrance region 2 into a tube exit region 3 where they are transported toward an ion-collection region 70. Ions from a source region 1 and a small portion of the gases are transferred to an ion-collection region 70, as shown by the general direction of ion flow 18.

The collection region 70 in this embodiment is intended to be the vacuum system of a mass spectrometer (interface stages, optics, analyzer, detector), such as but not limited to quadrupole, ion traps, time-of-flight, etc.; or other low-pressure ion and particle detectors. The ion source region 1 is intended to be, but not limited to, atmospheric pressure sources of ions or charged particles; including electrospray, atmospheric pressure chemical ionization, discharge and plasma sources, photo-ionization sources, laser ionization sources, and natural and synthetic sources of ions and charged particles such as sprays.

In the preferred embodiment, the base layers 20 are glass. However the base can consist of any other material that can serve as a nonconductive insulator, such as nylon, quartz, Vespel™, ceramic, various impregnated or laminated fibrous materials, etc. Alternatively, the base can consist of other resistive or dielectric material, such as ferrite, ceramics, etc., or laminates of insulator and dielectric materials. The bases 20 may vary in both cross-section and thickness depending on the field requirements for optimal transmission and the field requirements in the tube entrance region 2, the tube exit region 3, and inside the lumen 30 of the tube. The metal laminates 10 are fabricated from a conducting and preferably inert material, such as stainless steel, brass, copper, aluminum, etc. Heat may be supplied to the tube through a heat source 12 such at heating elements (isolated) or heated gas surrounding the tube. High voltage supplies 14 supply the voltages supplied to each metal laminate 10. Voltages can be provided to each laminate from separate supplies or through any variety of voltage divider circuits in order to deliver the precise voltage to each metal laminate from one or more voltage supplies of required voltage magnitude and polarity.

Sample from a source 150 is delivered to the ion-source region 1 by a delivery means 160 through an ion-source entrance wall 170. The ion-source chamber 1 is bounded by the wall 170, an electrode 110, and an ion-source cylindrical wall 130. The wall 170 is electrically isolated from the ion-source cylindrical wall 130 by a ring insulator 180 while a second ring insulator 190 isolates the cylindrical wall 130 from the electrode 110. Sample from the source 150 are gas-phase ions or charged particles or, alternatively, are neutral species, which are ionized or desorbed in the ion-source chamber 1. Heat may be applied directly to the ion-source region from the heat source 12. Heat may also be added to the gas from an ion source gas source 200 by heating an ion source gas inlet or any variety of methods for applying heat to confined regions containing gases.

Upstream of a metal entrance region wall element 100 of the tube is a tube entrance region 2, the electrode 110 with an aperture 120, and an ion-source region 1 adapted to contain a gas containing gas-phase ions. The element 100, electrode 110, and a ring insulator 140 bound region 2. The pressure in regions 1 and 2 should be sufficiently high to maintain viscous or chock flow through the tube, and in most applications it will. be atmospheric pressure or greater. Any combination of lumen and length of the tube can be selected to limit the flow of gas from the ion-source region 1 and the tube entrance region 2 into the tube exit region 3 so that the pressure can be maintained at pressure difference across the tube. Excess gas in region 3 is evacuated through an exhaust outlet 222 to an exhaust destination 220.

A DC voltage is applied to each metal laminate 10, exit region wall elements 60, 80, elements Or electrodes 100, 110, and wall 130, 170 creating an electrical field, although one or two separate power supplies in conjunction with resistor chains can also be used to supply the desired and sufficient potential to each laminate, electrode, and element. Additional lens elements can be incorporated between wall elements 80 and 60 if desired in order to focus the ions at the exit of the tube. Alternatively, in addition to the DC potential an RF potential may be applied to each successive metal laminate 10 so that the RF voltages of each successive metal laminate is 180 degrees out of phase with the adjacent metal laminate, although other relationships for the applied RF field would be likely appropriate. Under this embodiment, an electric field is created using a power supply and a resistor chain to supply the desired and sufficient voltage to each metal laminate to create the desired potential gradient throughout the tube, and focus and confine the ions to the center of the tube.

Gas can be added for concurrent flow of gas from region 1 into region 2 from the source gas source 200 introduced through the source gas inlet 202. In addition, gas can be added for a counter-flow of gas from region 2 into 1 from a tube entrance gas source 210 through a tube entrance gas inlet 212. Excess gas can be exhausted through the exhaust outlet 222 toward the exhaust destination 220. All gas supplies are regulated, metered, of adequate purity, and may be optionally heated to the meet the needs of the ion transmission application and to prevent condensation.

Figure 8:
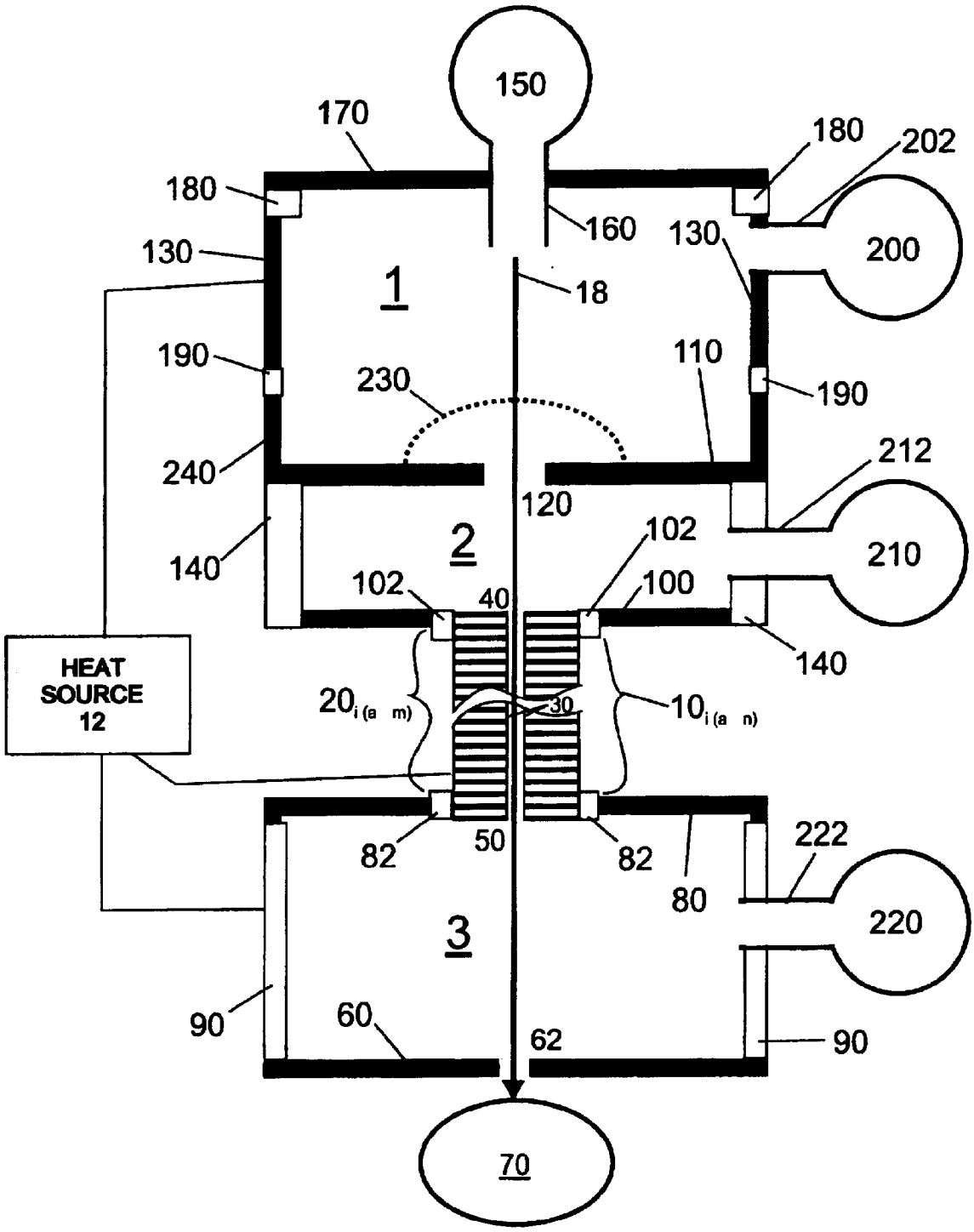
FIG. 8 shows a similar laminated tube configured with a high-transmission element incorporated into an atmospheric pressure ionization source with funnel-well optics.
Figure 9:
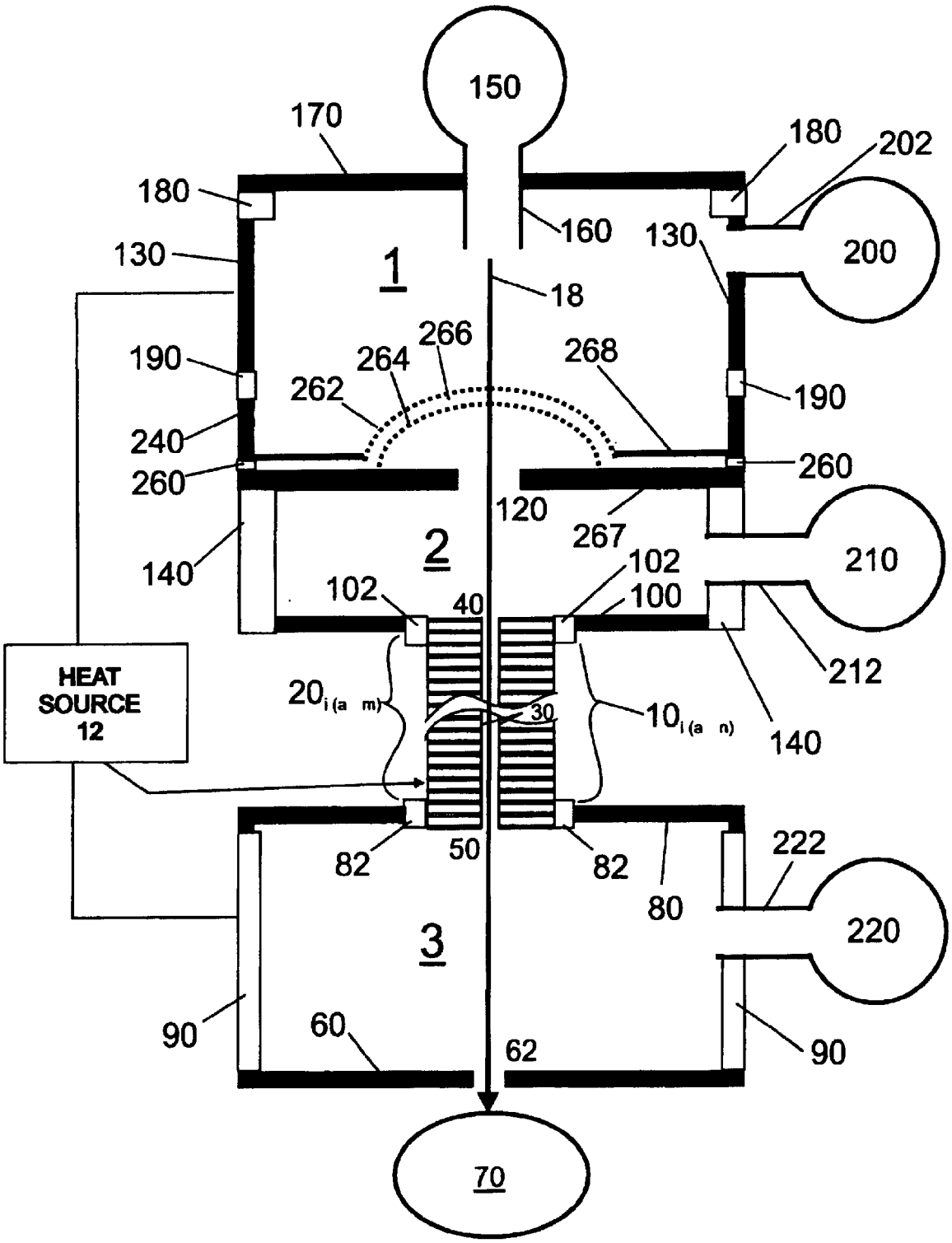
FIG. 9 shows a similar laminated tube configured with a laminated high-transmission element incorporated into an atmospheric pressure ionization source with funnel-well optics.

FIGS. 8 And 9—Additional Embodiment

Additional embodiments of the tube are shown in FIGS. 8 and 9. FIG. 8 shows a tube with a high-transmission element 230 with a back lens 250, and a shielding electrode 240 (as described in our co-pending U.S. patent application, Ser. No. 09/877,167 entitled "Apparatus and Method for Focusing Ions and Charged Particles at Atmospheric Pressure"), replacing the electrode 110, sandwiched between the ion-source region 1 and the entrance region wall element 100 of the tube; FIG. 9 shows a tube with a laminated high-transmission element 260 made up of front laminate 262, back laminate 264, interlaminate space 266, back lens 267, front lens 268, and shielding electrode 240 (as described in our co-pending U.S. provisional patent application, Ser. No. 601384,869 entitled "Laminated Lens for Focusing Ions from Atmospheric Pressure"), replacing the electrode 110, sandwiched between the ion-source chamber 1 and the entrance region wall element 100.

Figure 5B:
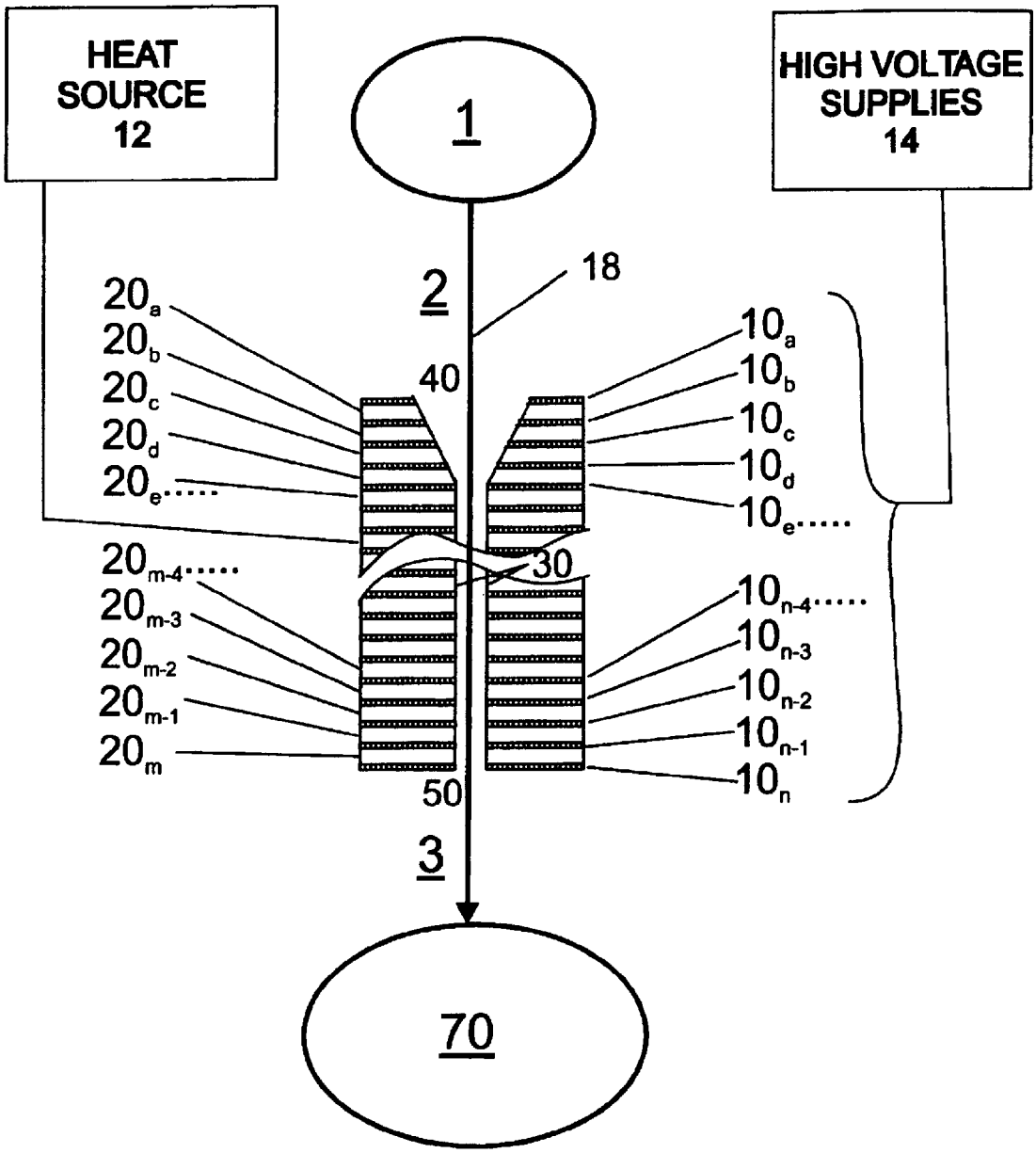
Figure 5C:
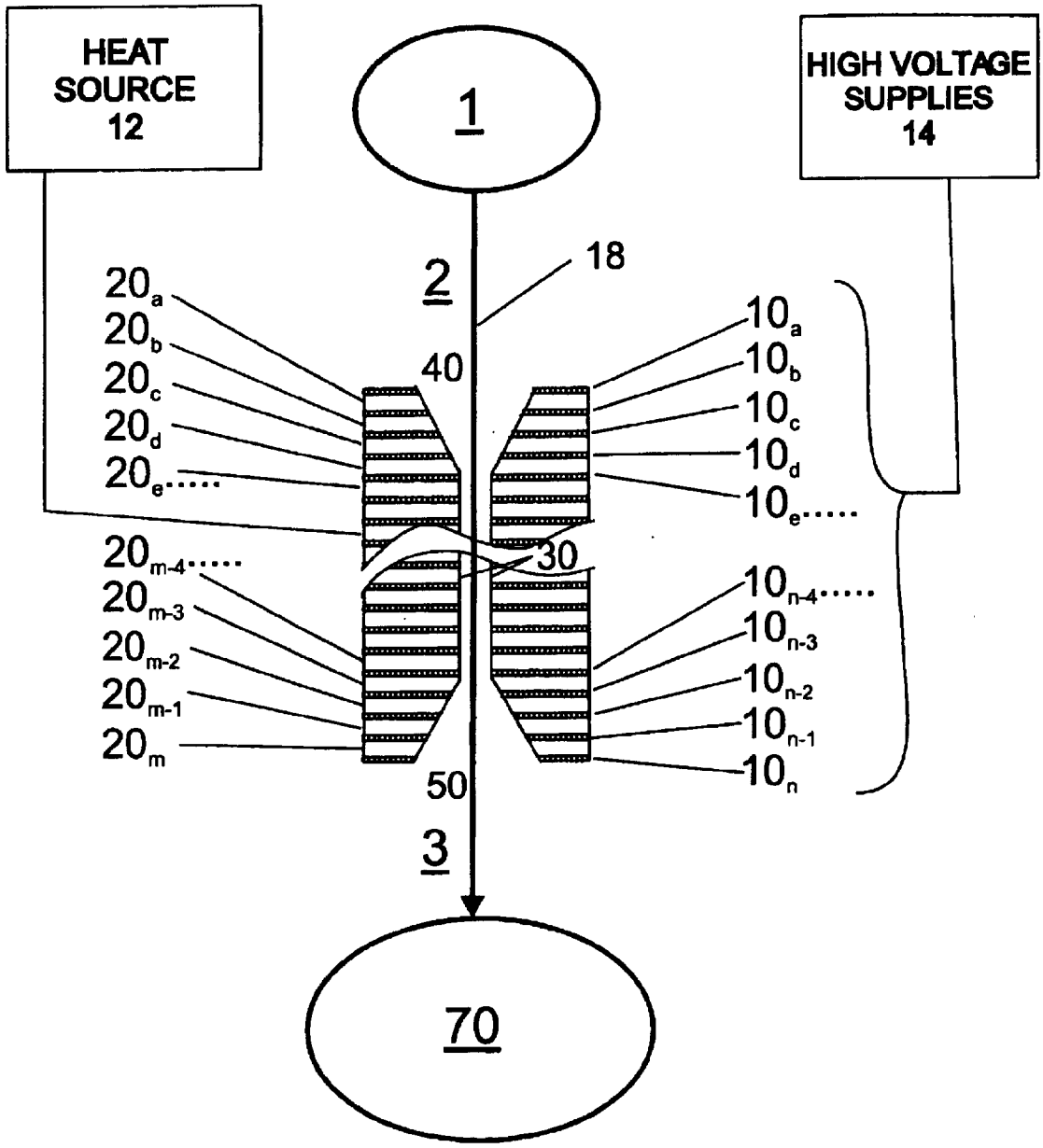
Figure 5D:
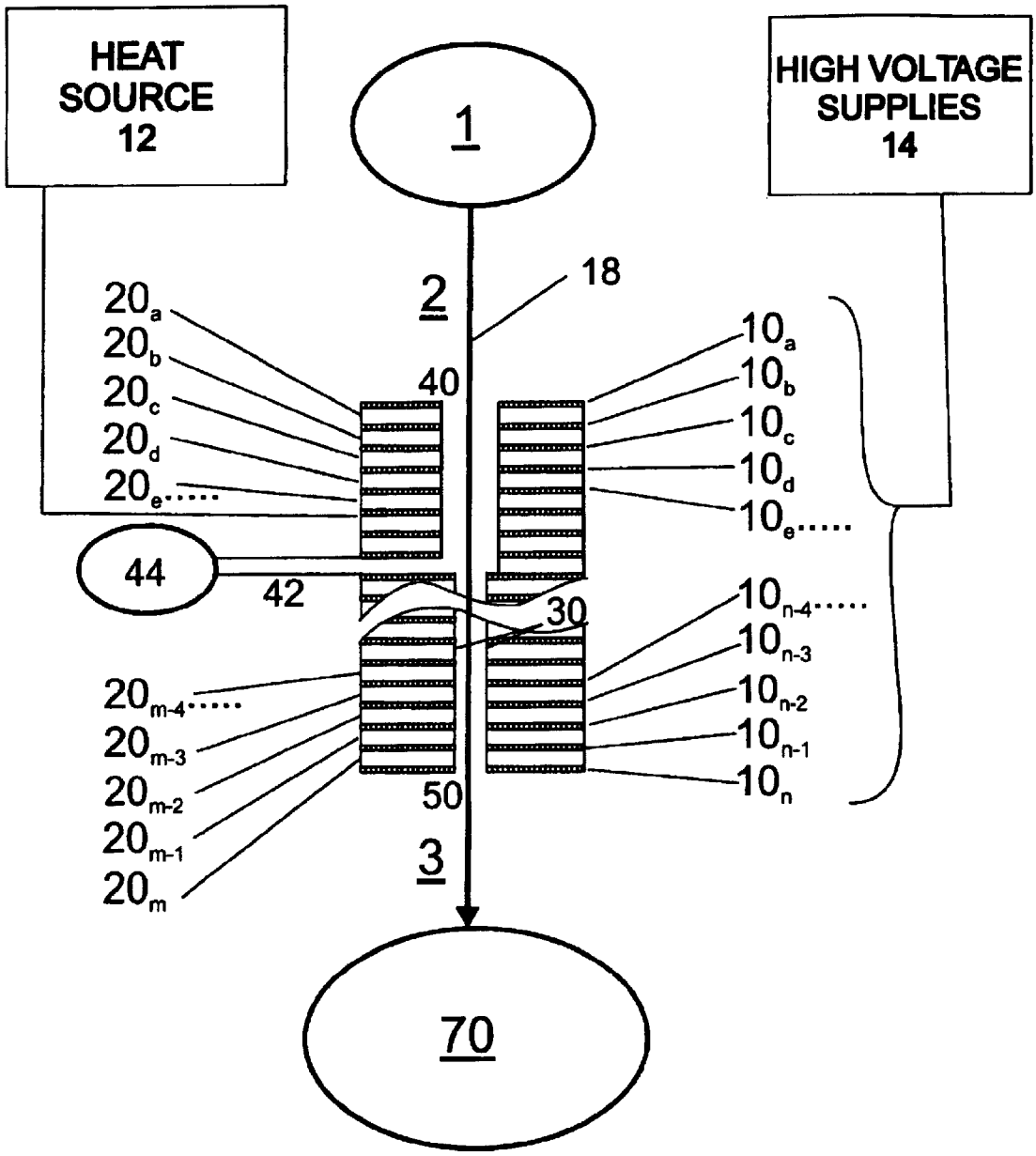

FIGS. 5B, 5C And 5D—Alternative Embodiments

There are various possibilities with regard to the geometry of the lumen of the tube. FIG. 5B shows a cross-sectional view of a tube composed of metal laminates with each adjacent laminate/base pair has a smaller diameter than the previous aperture, the collection of the apertures thus forming a funnel-shaped lumen. FIG. 5C shows a cross-sectional view of a tube composed funnel-shaped lumen at the entrance and exit thus forming an hour glass shaped lumen. FIG. 5D shows a cross-sectional view of a tube composed of laminates/base pairs with two tube diameters; the entrance diameter being larger than the exit diameter. The excess gas is exhausted mid-tube through a tube exhaust outlet 42 to a tube exhaust destination 44.

Alternatively, the tube can be manufactured by using the techniques of micro-electro-mechanical systems commonly referred to as MEMS: photolithography for creating patterns, etching or ablation for removing material, and deposition for coating surfaces with specific materials.

The ion collection region 70 is a general description for any device that is intended for use with streams of ions or charged particles. These include mass spectrometers, ion mobility spectrometers, light scattering detectors, particle detectors, ion deposition devices, particle deposition devices, semi-conductors fabrication devices, and printers.

Advantages

From the description above, a number of advantages of out laminated tube become evident:

(a) The delayed dispersion of ions until the tube flow is fully developed eliminates the substantial entrance losses associated with conventional tube devices.

(b) The ability to precisely control the electric field the entire length of the tube allows the tube to operate at high electric field in the entrance region and low electric field in the exit region. This allows for maximum ion transmission without electrical breakdown near the minimum of the Paschen Curve.

(c) The significant improvement in ion transmission minimizes contamination on the surfaces of the tubes and minimizes the occurrence of charging related to contamination.

(d) The use of relatively small capacitive surfaces within the laminated tube reduces the likelihood of surface charging and catastrophic discharges.

(e) The use of rf voltages on elements with fully developed flow assists in focusing the ions within the tube or at the exit and minimizes diffusion losses with longer tubes.

(f) The increased effective aperture associated with the device allows efficient collection of ion beams emanating from high compression funnel/well ion optics at atmospheric pressure.

(g) The higher ion transport efficiency of the laminated tube can also result in a much reduced gas load on the vacuum system for a given ion current. This has significant benefit in reducing the pumping requirements, cost, and complexity of vacuum systems associates with mass spectrometer.

(h) The use of rf voltages on selected laminated elements can be used to selected ions in either high pass filter mode or band pass mode. Higher selectivity of the inlet of a mass spectrometer has the significant benefit of reducing interferences and improving analytical results.

(i) The use of above atmospheric pressure sources with high transmission current to atmospheric pressure regions presents the analyst or fabricator with a relatively high current and low field source of ions for implantation, deposition, or reaction with surfaces, particles, or gases.

(j) The use of above atmospheric pressure sources with high current will have a direct benefit as a low field external source of reagent ions for atmospheric pressure chemical ionization. This will improve sensitivity and potentially specificity of mass spectral analysis.

(k) The use of laminated tubes in parallel arrays will have the advantage of increasing the ion transmission cross-section while significantly reducing the gas load on the low-pressure side of the capillary.

Operations—FIGS. 5 Through 11

The manner of using the laminated tube to control the potential applied to the ions or charged particles entering, traversing, and exiting the tube is described. Gas-phase ions or charge particles formed in either low- or high-field sources, including, but not limited to electrospray, atmospheric pressure chemical ionization, photo-ionization, electron ionization, laser ionization and desorption (including matrix assisted), inductively coupled plasma, discharge ionization; etc. are presented to the entrance region 2 by any variety of focusing and transmitting devices, incorporating optical and aerodynamic means to collect ions at or near the entrance of the tube. The device is operated with the entrance region 2 held at a pressure substantial higher than the pressure maintained in region 3. Typical values from an atmospheric source would be atmospheric or near atmospheric in region 2 and 1 to 10 Torr in region 3. This pressure difference will facilitate viscous tube flow inside the tube. Under these flow conditions, the gas velocities at the entrance of the tube will be much less than the velocities inside the tube after the flow profile is fully developed. It is the intension of this device to delay the application of diverging fields until the velocity profile of tube flow is fully developed. Under fully developed gas flow, the diverging field will have a substantially lower effect on the transport of ions to the walls of the tube. The important consideration in the operation of this invention is the precise control of forces experienced by the ions and particles at each point along the pathway through the tube. The decreased loss of charged species to the walls will result in increased transmission of ions and charged particles for subsequent collection, focusing, and or detection.

Figure 6:
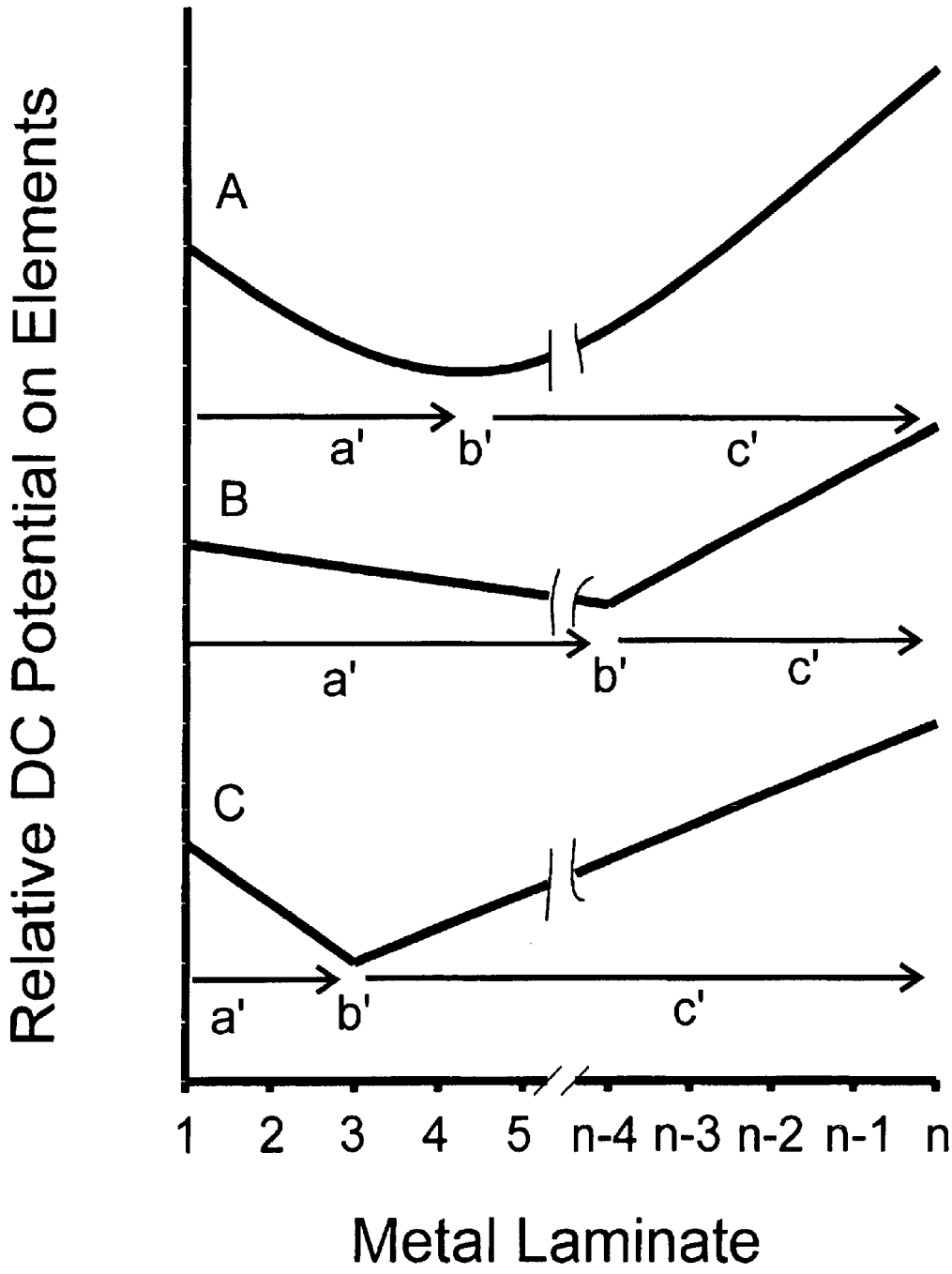

FIG. 6 shows the changes in the potential experienced by the ions as they move through the tube for various settings of the DC voltage of the individual metal laminates 10. Section a' of the three graphs showing the potential experienced by the ions decreasing as they move from the entrance of the tube, through the tube, minimizing at point b'; and increasing as the ions move from point b' toward the exit of the tube, section c'. All three of these configurations illustrating that the electric potential of the ions can be controlled at any point along the tube. In this manner, the divergence of ions can be delayed until the gas flow profile within the tube is fully developed. Under these conditions, viscous flow will have a more dominant effect on the motion of ions and prevent them from migrating to the walls of the tube.

Curve A shows the change in potential of the ions as they move through the tube, the potential decreasing at a steep linear slope (section a') from the entrance of the tube to point b', with point b' near the entrance of the tube, and abruptly increasing the potential en (section c') at a swallow linear slope from point b' to the exit of the tube. Thereby gradually exposing the ions to the dispersive electric fields (section c') of the increasing potentials on the metal laminates.

Curve B shows the change in potential of the ions as they move through the tube, the potential energy decreasing at a shallow linear slope (section a') from the entrance of the tube to point b', with point b' near the exit of the tube, and increasing (section c') at a steep linear slope from point b' to the exit of the tube. Thereby allowing the ions to be well established in the center of the tube before abruptly increasing the potential of the ions and exposing the ions to the dispersive electrical fields (section c') of the. increasing potential on the metal laminates.

Curve C shows the changes in the potential of the ions as they move through the tube, the potential gradually decreasing (section a') from the entrance of the tube to point b', in the middle of the tube, and then gradually increasing the potential of the ions (section c') to the exit of the tube. Thereby allowing gradual changes in the potential of the ions as they pass through the tube and exposing the ions to focusing (section a') and dispersive (section c') electrical field lines gradually.

The tube-laminate allows the matching of the flow profile and the electric fields experienced by the ions and particles as they traverse the tube. Tube flow can be controlled by tube diameter, pressure difference across the tube, entrance and exit geometry, gas composition, temperature, and other surface properties (some variations are illustrated in FIGS. 5A–D). The device will operate by selecting the "experiment-required" flow parameters, then matching the fields to the application. For example, placing the bottom of the potential well within the tube will allow the ion source to operate at or near ground potential, while allowing the exit of the tube to also be held at or near ground potential. The potential gradient can also be precisely controlled with this device in order to minimize high field at the lower pressure end of the tube; thus preventing electrical discharge when the exit of the tube is under vacuum.

Figure 11:
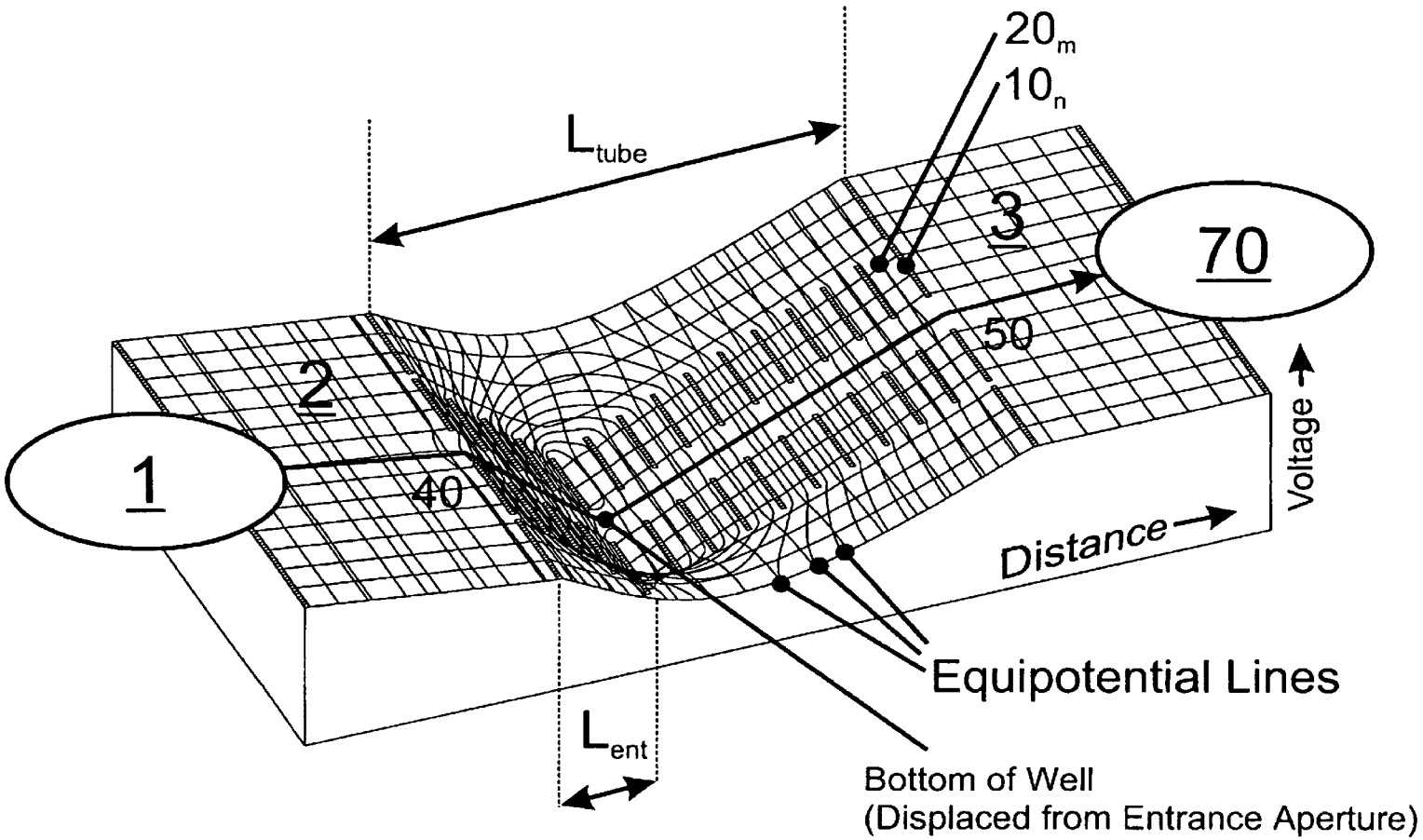
FIG. 11 shows a potential surface of the tube laminate showing the bottom of the potential well displaced from the entrance aperture where inner-tube flow is well established.

FIG. 11 shows a potential surface of the tube-laminate in operation with the ion motion 18 being perpendicular to equipotential lines 300 within the tube. At the bottom of a potential well 302 the ions cease to follow the diverging field because their motion is dominated by viscous flow.

The electric potential experienced by ions traveling through the tube is governed dimensionally by the diameter, spacing, and applied voltage of the metal laminates 10. Although the enclosed figures show uniform spacing between respective laminates, the distance between each laminate, controlled by the specific dimension of base layers 20 can vary from layer to layer depending on the local field requirements. Large distances along the tube with uniform field requirements can be accommodated with a single base layer.

Another important mode of operation of the tube-laminate is from above atmospheric pressure sources of ions into at (or near) atmospheric pressure exit region 3. Note that tube flow is governed by pressure difference, not absolute pressure. The tube-laminates can also have applications in series with tubes and multiple potential wells.

When the tube laminate is operated with vacuum conditions in region 3, any number of evacuation devices can serve as the exhaust destination; including, roughing pumps, turbo pumps, cryo-pumps, etc.

Gas flowing in a direction that is counter to the movement of ions will serve to reduce or eliminate contamination from particulate materials and neutral gases in the tube. Operation with a counter-flow of gas is accomplished by adding a sufficient flow of gas (optionally heated) from the entrance tube gas source 210 flowing out through the inlet 212, through the aperture 120 and into the ion-source region 1, to prevent contamination of the wall element 100 and prevent droplets from entering the entrance aperture 40 of the tube. In addition, lower mobility charged particles or ions may also be swept away in the counter-flow of gas.

Conclusion, Ramification, and Scope

Accordingly, the reader will see that the laminated tubes of this invention can be used to transport ions from an atmospheric or higher pressure ion source region into lower pressure regions. Further more, the laminated tube has the additional advantages in that:

It is compatible technology for implementation on most existing atmospheric pressure sources used in modem mass spectrometry and ion mobility spectroscopy.

The need for high current sources of ions across pressure regimes is evident in the manufacture of semiconductors, micro-electronics, nano-components, thin film deposition, etc.

Although the description above contains many specifications, these should not be construed as limiting the scope of the invention but as merely providing illustrations of some of the presently preferred embodiments of this invention. For example the lumen of the tube can have other shapes, such as oval, square, triangular, etc.; ions can be formed by natural or synthetic means; the number of and distance between adjacent metal laminates of the tube can vary depending on the source of ions, the ion collection region, the respective pressure of each region or a combination thereof; the laminates in the area of the inlet of the tube can have larger openings to accommodate dispersive ion sources, while the laminates at the exit of the tube can have larger openings to facilitate the formation of a an ion-beam or a combination thereof utilized; etc.

We also envision that the present device may operate with bundles of parallel tube-laminates for some ion transfer applications where smaller tube diameters or larger flows may be required. Alternatively, we envision splitting the flow (As shown in FIG. 5D) in applications where minimal conductance into vacuum is required.

We also envision the use of both dc and rf voltages within the lumen of this device to selectively manipulate ions from any variety of sources to any variety of ion destinations.

Thus the scope of the invention should be determined by the appended claims and their legal equivalents, rather than by the examples given.

We claim:

1. An apparatus for transferring gas-phase ions or particles from an ion source region into an ion collection region, the improvement wherein said apparatus comprising:

a. a dispersive source of ions;

b. a stratified tube consisting of a plurality of elements, said elements comprise alternating layers of metal electrodes and dielectric insulators, through which at least some of said ions from said ion source pass unobstructed;

c. a tube exit region, one wall of which is formed by an exit element of said stratified tube, said tube exit region upstream of said ion collection region, and means for maintaining the ambient pressure in said tube exit region substantially below that in said ion source;

d. means for maintaining a potential difference between said ion source and said stratified tube which is equal to that required to pass substantially all said ions into inlet of said stratified tube;

e. means for maintaining a potential between said individual elements of said stratified tube which is at least as great as that required to maintain the direction of said ions at or near coaxial within stratified tube; and f. means for maintaining and controlling the temperature of said stratified tube.

2. Apparatus as in claim 1 wherein said ion source region is at or near atmospheric pressure, gas-phase ions are formed by means of atmospheric or near atmospheric pressure ionization, electrospray, atmospheric pressure chemical ionization, laser desorption, photioization, discharge ionization sources, natural ionization; or a combination thereof.

3. Apparatus as in claim 1 further including an analytical apparatus in said ion collection region, said analytical apparatus comprises a mass spectrometer or ion mobility spectrometer or combination thereof, a wall with an aperture separates said tube exit region from said ion collection region, said ions in said tube exit region pass through said aperture into said ion collection region where they are analyzed by mass spectrometric means.

4. Apparatus as in claim 1 wherein said ion source is at a pressure greater than atmospheric pressure.

5. Apparatus as in claim 4 further including said tube exit region at or near atmospheric pressure.

6. Apparatus as in claim 1 further including a high-transmission element, sandwiched between said ion source and said stratified tube, said high-transmission element being comprised of a thin metal electrode populated with a plurality of openings, said plurality of openings provide conduits for said ions from said ion source to pass through on their way to said stratified tube, electrostatic potential of said high-transmission element is such that the electrostatic fields on underside of said high-transmission surface is greater than electrostatic fields in said ion source and less than electrostatic fields from said stratified tube, whereby substantially all said gas-phase ions from said ion source are attracted to and pass through said plurality of openings exiting said conduits and are transferred into inlet opening of said stratified tube.

7. Apparatus as in claim 6 further including a pure gas supplied in such a way between said inlet of said stratified tube and said high-transmission element, whereby substantially all said gas flows through said plurality of openings in said high-transmission element and into said ion source region, flowing counter to the trajectories of said gas-phase ions.

8. Apparatus as in claim 6 wherein said high-transmission element can be comprises of a laminated structure populated with a plurality of openings providing conduits from said ion source region to a region upstream of said stratified tube for the purpose of collecting and transferring substantially all said ions from said ion source to said inlet of said stratified tube, said laminated surface having an insulating base and metal laminate on topside and underside of said insulating base, electrostatic potential difference between said metal laminates on top-side and underside is such that the electrostatic field on underside of said laminated high-transmission surface is greater than electrostatic field on topside of said surface and greater still than electrostatic field from said ion source, whereby substantially all said gas-phase ions from said ion source are focused into said plurality of openings, passing through said laminated element and being directed into said inlet of stratified tube.

9. Apparatus as in claim 1 wherein the ratio of diameter of the lumen of said tube to the thickness of said individual metal electrodes is greater than 1-to-1.

10. Apparatus as in claim 1 wherein the ratio of thickness of said dielectric insulator to the thickness of said individual metal electrodes is less than 20-to-1, in the region where dispersive electric fields are present.

11. Apparatus as in claim 1 further including a pure gas supplied in such a way between said inlet of said stratified tube and ion source region, whereby substantially all said gas flows into said ion source region, flowing counter to the trajectories of said gas-phase ions.

12. Apparatus in claim 1 further including at least one of said metal electrodes has RF potential.

13. An apparatus for transferring gas-phase ions or particles from an ion source region into an ion collection region for mass spectrometric analysis, the improvement wherein said apparatus comprising:

a. a dispersive source of ions;

b. a stratified tube consisting of a plurality of elements, said elements comprise alternating layers of metal electrodes and insulating materials, through which at least some of said ions from said ion source pass unobstructed;

c. a high-transmission surface sandwiched between said ion source and said stratified tube, said surface populated with a plurality of openings through which substantially all said ions pass unobstructed, said laminated surface having an insulating base and metal laminate on topside and underside of said insulating base;

d. an tube exit region, one wall of which is formed by an exit element of said stratified tube, another wall with an aperture which separates said tube exit region from said ion collection region, means for maintaining the ambient pressure in said tube exit region substantially below that in said ion source;

e. means for maintaining a potential difference between said metal laminates on topside and underside of said high-transmission surface which is equal to that required to attract substantially all said ions toward said metal laminate on topside of said high-transmission element to pass said ions unobstructed through said plurality of openings in said high-transmission element;

f. means for maintaining a potential difference between said metal laminate on under-side of said high-transmission element and said stratified tube which is equal to that required to pass substantially all said ions that have exited openings in said high-transmission element into inlet of said stratified tube; and g. means for maintaining a potential between said individual elements of said stratified tube which is at least as great as that required to maintain the direction of said ions at or near coaxial within stratified tube wherein said ions are transferred through said aperture in said wall separating said tube exit region and said ion collection region, and said ions are analyzed by means of mass spectrometric analysis in said ion collection region.

14. Apparatus as in claim 13 wherein said ion source region is at or near atmospheric pressure, said gas-phase ions are formed by means of atmospheric or near atmospheric pressure ionization, electrospray, atmospheric pressure chemical ionization, laser desorption, photioization, discharge ionization sources, natural ionization; or a combination thereof.

15. Apparatus as in claim 13 further including electrostatic and time varying lens in said ion collection region for the collection, transfer, and mass spectrometric analysis of said ions.

16. Apparatus as in claim 13 further including a pure gas supplied in such a way between said inlet of said stratified tube and said high-transmission surface, whereby substantially all said gas flows through said openings in said laminated high-transmission surface and into said ion source region flowing counter to the trajectories of said gas-phase ions.

17. A method for collection and transfer of ions or charged particles from an ion source region, transferring approximately all said ions or charged particles into a lower pressure region, comprising:

a. providing a perforated high-transmission surface populated with a plurality of openings, said high-transmission surface made up of an insulating base and metal laminates contiguous with topside and underside of said base;

b. applying an electrostatic potential gradient across said laminated surface, such that electrostatic field lines between said ion source and said perforated high-transmission surface are concentrated into said plurality of openings wherein substantially all said ions are directed through said openings unobstructed into a region downstream of said high-transmission surface;

c. providing electrostatic attraction to said ions in said region downstream of said perforated high-transmission surface with a electrostatic field generated by a stratified tube, said stratified tube made up of alternating electrodes and insulating bases, said electrostatic field between said high-transmission surface and said stratified tube are concentrated into entry or opening of said stratified tube as a reduced cross-section area;

d. providing a pure gas supplied in such a way that said gas flows between said opening of said stratified tube and said high-transmission surface, whereby substantially all said gas flows through said plurality of openings and into said ion source region, flowing counter to the trajectories of said ions;

e. applying an electrostatic potential gradient along said stratified tube such that electrostatic field lines direct said ions at or near coaxial within the lumen of said stratified tube;

f. directing substantially all said ions as they exit said stratified tube into said lower pressure region into a collection region;

whereby said stratified tube can be used to transfer substantially all said ions formed at or near atmospheric pressure into said ion collection region for mass spectrometric analysis.

18. A method for collection and transfer of ions or charged particles from an ion source region, transferring approximately all said ions or charged particles into a lower pressure region, the method comprising:

a. providing electrostatic attraction to said ions in said ion source region with a electrostatic field generated by a stratified tube, said stratified tube made up of alternating electrodes and insulating bases, said electrostatic field between said ion source region and said stratified tube are concentrated into entry or opening of said stratified tube as a reduced cross-section area;

b. applying an electrostatic potential gradient along said stratified tube such that electrostatic field lines direct said ions at or near coaxial within the lumen of said stratified tube;

c. directing substantially all said ions as they exit said stratified tube into said lower pressure region;

whereby said stratified tube can be used to transfer substantially all said ions into said lower pressure for collection, deposition or a combination thereof.

19. The Method of claim 18 wherein said ion source is at a higher pressure than atmospheric pressure, resulting in the pressure in said lower pressure region at or near atmospheric pressure.

20. Apparatus as in claim 18 wherein one or more of said electrodes in stratified tube has a RF potential applied to it resulting in enhanced focusing of said ions into the center of the lumen of said tube.

21. Apparatus as in claim 18 wherein one or more of said electrodes in stratified tube has a RF potential applied to it resulting in differential transmission of said ions based on ion mobility.

* * * * *